US007379043B2

(12) United States Patent
Worley, III et al.

(10) Patent No.: US 7,379,043 B2
(45) Date of Patent: May 27, 2008

(54) DISPLAY WITH MULTIPLEXED PIXELS

(75) Inventors: William Spencer Worley, III, Half Moon Bay, CA (US); Edwin Lyle Hudson, Los Altos, CA (US); Wing Hong Chow, San Jose, CA (US)

(73) Assignee: Aurora Systems, Inc., San Jose, CA (US)

( * ) Notice: Subject to any disclaimer, the term of this patent is extended or adjusted under 35 U.S.C. 154(b) by 15 days.

(21) Appl. No.: 11/231,123

(22) Filed: Sep. 20, 2005

(65) Prior Publication Data

US 2006/0012594 A1 Jan. 19, 2006

Related U.S. Application Data

(63) Continuation of application No. 09/536,858, filed on Mar. 27, 2000, now Pat. No. 6,980,188, which is a continuation of application No. 09/075,472, filed on May 8, 1998, now Pat. No. 6,067,065.

(51) Int. Cl.
*G09G 3/36* (2006.01)

(52) U.S. Cl. ..... 345/90; 345/89; 345/98; 345/690; 345/208

(58) Field of Classification Search ..... 345/205, 345/690–692, 208, 211–214, 89, 90, 92–94, 345/96, 98–100
See application file for complete search history.

(56) References Cited

U.S. PATENT DOCUMENTS 5,712,652 A * 1/1998 Sato et al. ..... 345/90
5,945,972 A * 8/1999 Okumura et al. ..... 345/98
5,959,598 A * 9/1999 McKnight ..... 345/90
6,072,454 A * 6/2000 Nakai et al. ..... 345/97
6,115,017 A * 9/2000 Mikami et al. ..... 345/92
6,127,995 A * 10/2000 Furuhashi et al. ..... 345/96
6,239,780 B1 * 5/2001 Walker et al. ..... 345/102

* cited by examiner

*Primary Examiner*—Henry N Tran
(74) *Attorney, Agent, or Firm*—Henneman & Associates, PLC; Larry E. Henneman, Jr.

(57) ABSTRACT

A multiplexed pixel display includes a plurality of pixel electrodes, a plurality of storage elements, a first voltage supply terminal, a second voltage supply terminal, a common electrode, and a plurality of multiplexers each selectively coupling an associated one of the pixel electrodes with one of the first voltage supply terminal and the second voltage supply terminal responsive to a value of a data bit stored in an associated one of said storage elements. A controller is configured to sequentially write each bit of multi-bit data words to the storage elements, and assert, while each bit is stored in the storage elements, a first predetermined voltage on the first voltage supply terminal, a second predetermined voltage on the second voltage supply terminal, and a third predetermined voltage on the common electrode, for a time dependent on the significance of the stored bit. Various alternate controllers facilitate the use of additional driving schemes.

13 Claims, 33 Drawing Sheets

| VCn = 0V<br>Vtt = 1V<br>Vsat = 3V<br>VCi = VCn + Vsat + Vtt = 4V | | |
|---|---|---|
| | Normal | Inverted |
| VC | 0V | 4V |
| V1 | 3V | 1V |
| V0 | 1V | 3V |

| VC = 3V<br>Vtt = 1V<br>Vsat = 3V | | |
|---|---|---|
| | Normal | Inverted |
| VC | 3V | 3V |
| V0 | 4V | 2V |
| V1 | 6V | 0V |

| VCn = 0V<br>VCi = 5V<br>Vtt = 1V<br>Vsat = 3V | | |
|---|---|---|
| | Normal | Inverted |
| VC | 0V | 5V |
| V0 | 1V | 4V |
| V1 | 3V | 2V |

DISPLAY WITH MULTIPLEXED PIXELS

RELATED APPLICATIONS

This application is a continuation of U.S. patent application Ser. No. 09/536,858 (now issued as U.S. Pat. No. 6,980,188) filed Mar. 27, 2000 by the same inventors, which is a continuation of U.S. patent application Ser. No. 09/075,472 (now issued as U.S. Pat. No. 6,067,065), filed May 8, 1998 by the same inventors, both of which are incorporated herein by reference in their entirety as if fully set forth herein.

BACKGROUND OF THE INVENTION

1. Field of the Invention

This invention relates generally to electronic driver circuits, and more particularly to a novel circuit and method for driving a display by multiplexing predetermined voltages to achieve modulation between saturation and threshold voltages of pixel electrodes in a liquid crystal display.

2. Description of the Background Art

FIG. 1 shows a single pixel cell 100 of a typical liquid crystal display. Pixel cell 100 includes a liquid crystal layer 102, contained between a transparent common electrode 104 and a pixel storage electrode 106, and a storage element 108. Storage element 108 includes complementary data input terminals 110 and 112, data output terminal 114, and a control terminal 116. Responsive to a write signal on control terminal 116, storage element 108 reads complementary data signals asserted on a pair of bit lines (B+ and B−) 118 and 120, and latches the signal on output terminal 114 and coupled pixel electrode 106.

Liquid crystal layer 102 rotates the polarization of light passing through it, the degree of rotation depending on the root-mean-square (RMS) voltage across liquid crystal layer 102. The ability to rotate the polarization is exploited to modulate the intensity of reflected light as follows. An incident light beam 122 is polarized by polarizer 124. The polarized beam then passes through liquid crystal layer 102, is reflected off of pixel electrode 106, and passes again through liquid crystal layer 102. During this double pass through liquid crystal layer 102, the beam's polarization is rotated by an amount which depends on the data signal being asserted on pixel storage electrode 106. The beam then passes through polarizer 126, which passes only that portion of the beam having a specified polarity. Thus, the intensity of the reflected beam passing through polarizer 126 depends on the amount of polarization rotation induced by liquid crystal layer 102, which in turn depends on the data signal being asserted on pixel storage electrode 106.

Storage element 108 can be either an analog storage element (e.g. capacitative) or a digital storage element (e.g., SRAM latch). In the case of a digital storage element, a common way to drive pixel storage electrode 106 is via pulse-width-modulation (PWM). In PWM, different gray scale levels are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0-15) different gray scale values possible, depending on the number of "high" pulses asserted during the frame time. The assertion of 0 high pulses corresponds to a gray scale value of 0 (RMS 0V), whereas the assertion of 15 high pulses corresponds to a gray scale value of 15 (RMS 5V). Intermediate numbers of high pulses correspond to intermediate gray scale levels.

FIG. 2 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low), the third pulse B1 (2 intervals wide) is high, and the last pulse B0 (1 interval wide) is low. This series of pulses results in an RMS voltage that is approximately $$\sqrt{\frac{2}{3}}$$

(10 of 15 intervals) of the full value (5V), or approximately 4.1V.

The resolution of the gray scale can be improved by adding additional bits to the binary gray scale value. For example, if 8 bits are used, the frame time is divided into 255 intervals, providing 256 possible gray scale values. In general, for (n) bits, the frame time is divided into ($2^n$−1) intervals, yielding ($2^n$) possible gray scale values.

Because the liquid crystal cells are susceptible to deterioration due to ionic migration resulting from a DC voltage being applied across them, the above described PWM scheme is modified as shown in FIG. 3. The frame time is divided in half. During the first half, the PWM data is asserted on the pixel storage electrode, while the common electrode is held low. During the second half of the frame time, the complement of the PWM data is asserted on the pixel storage electrode, while the common electrode is held high. This results in a net DC component of 0V, avoiding deterioration of the liquid crystal cell, without changing the RMS voltage across the cell, as is well known to those skilled in the art.

FIG. 4 shows a response curve of an electrically controlled, birefringent liquid crystal cell. The vertical axis 402 indicates the percent of full brightness (i.e., maximum light reflection) of the cell, and the horizontal axis 404 indicates the RMS voltage across the cell. As shown, the minimum brightness (a dark pixel) is achieved at an RMS voltage Vtt. For some wavelengths of light, an RMS voltage less than Vtt results in a pixel that is not completely dark, as shown in FIG. 4. For other wavelengths all RMS voltages less than Vtt result in a dark pixel. In the portion of the curve between Vtt and Vsat, the percent brightness increases as the RMS voltage increases, until 100% full brightness is reached at Vsat. Once the RMS voltage exceeds Vsat, however, the percent brightness decreases as the RMS voltage increases.

FIG. 5 shows an RMS voltage versus gray scale value curve, for an 8-bit (256 gray scale values) gray scale system. The RMS voltage for each gray scale value ("Gray Value") is given by the following formula, where Von is the digital "on" value, typically Vdd:

$$Vrms=\sqrt{(1/255)(\text{GrayValue})(Von)^2}$$

Gray scale value (x) corresponds to an RMS voltage equal to Vtt and, referring back to FIG. 4, to 0% brightness (i.e., minimum brightness which may not achieve exactly 0 brightness). Thus, the gray scale values less than value (x) are unusable, because for some wavelengths of light, they result in a brighter rather than a darker pixel, and for other wavelengths, the values result in 0% brightness and are, therefore, redundant. Similarly, value (y) corresponds to an RMS voltage equal to Vsat and, referring back to FIG. 4, to 100% full brightness. Thus, the gray scale values greater than value (y) are also unusable, because they result in a darker rather than a brighter pixel. The result of these wasted values is that true 8-bit gray scale resolution is not obtained.

In order to avoid gray scale distortions, all gray scale values must be confined to the useful portion of the liquid crystal response curve (FIG. 4) between Vtt and Vsat. One way to accomplish this is to add an additional bit to the gray scale code (e.g., use a 9-bit gray scale system) and then map the 8-bit values to the values of the 9-bit system corresponding to the useful portion of the response curve. The addition of a single bit, however, increases the bandwidth requirements of the data interface by 100%, and is, therefore, undesirable. What is needed is a system and method for confining all of the available gray scale values to the useful portion of the liquid crystal response curve.

In addition to the problem of confining all of the grayscale values to the useful portion of the liquid crystal response curve, it is also difficult to implement the debiasing (i.e., maintaining a net D.C. bias of 0V across the pixel cells). For example, the voltage being asserted on the common electrode cannot be changed while data is being asserted on the pixel electrodes. To do so, would change the data being asserted on the display (converting high signals to low signals and vice versa) and distort the displayed image. Further, because of the substantial amount of time required to write data to the display, it is difficult to rapidly write an "on" state or an "off" state to the entire display. Additionally, in order to invert the data in the display, the complement of the data must be written to each pixel of the display.

What is needed is a display capable of rapidly inverting the stored data, rapidly implementing on and off states, and providing write time flexibility.

SUMMARY

Novel methods for driving a novel display are described. In an exemplary embodiment of the display, each pixel cell includes a multiplexer for selectively coupling the pixel electrode to one of two global voltage supply terminals, responsive to a data bits stored in the pixel cell. This configuration provides many advantages over prior art displays which assert the stored data bits directly onto the pixel electrode. For example, in the present invention, the pixel electrodes can be digitally driven with voltages higher or lower than the voltages used to drive the logic circuitry of the display, thus providing flexibility with respect to the time periods that particular bits must be written to the pixel. Additionally, off states (i.e., no voltage across a pixel cell) can be written to all of the pixels of the display at one time, without changing any of the data stored in the pixel cells, by asserting appropriate voltages on the global voltage supply terminals and a common electrode overlaying the entire pixel array. Yet another advantage provided by the present invention is that the pixel cells can be debiased without the extra step of loading complementary data bits into the display, simply by asserting various predetermined voltages on the global voltage supply terminals.

The methods of the present invention may be implemented with a voltage controller for asserting various predetermined voltages on the voltage supply terminals under the control of a processing unit executing code embodied in a computer readable medium (e.g., a RAM or a ROM).

According to one method of the present invention, the voltage controller asserts a reference voltage on the common electrode of the display, asserts the saturation voltage of the display on one of the voltage supply terminals, and asserts the threshold voltage of the display on the other of the voltage supply terminals. Then, each bit of a multi-bit data word is sequentially written to the pixel cells of the display, allowing each bit to remain in the pixel cells for a period of time dependent on the significance of each bit.

An alternate method includes the steps of sequentially writing each bit of a multi-bit data word to storage elements of the pixel cells; and asserting, while each bit is stored in the storage elements, a first predetermined voltage on the first voltage supply terminal, a second predetermined voltage on the second voltage supply terminal, and a third predetermined voltage on the common electrode, all for a time dependent on the significance of said stored bit to modulate the cells of the display. Optionally, this method includes the further steps of asserting, while each bit is stored in the storage elements, a fourth predetermined voltage on the first voltage supply terminal, a fifth predetermined voltage on the second voltage supply terminal, and a sixth predetermined voltage on the common electrode, for a time dependent on the significance of the stored bit, in order to debias the pixel cells.

BRIEF DESCRIPTION OF THE DRAWINGS

The present invention is described with reference to the following figures, wherein like reference numbers denote substantially similar elements.

DETAILED DESCRIPTION

The present invention overcomes the problems associated with the prior art by using display data bits to control the multiplexing of predetermined voltages onto pixel electrodes of a display, as opposed to asserting the data bits directly on the pixel electrodes. The present invention is described with reference to particular embodiments. Numerous specific details are set forth (e.g., the number of data bits in a particular data word, the on or off chip disposition of various voltage sources, and the number of different voltage sources necessary to implement particular modulation/debias schemes) in order to provide a thorough understanding of the invention. Those skilled in the art will understand that the invention may be practiced apart from these specific details. In other instances, well known details of display driving circuits (e.g., writing data to pixel storage cells of a display) are omitted, so as not to unnecessarily obscure the present invention.

Figure 6:
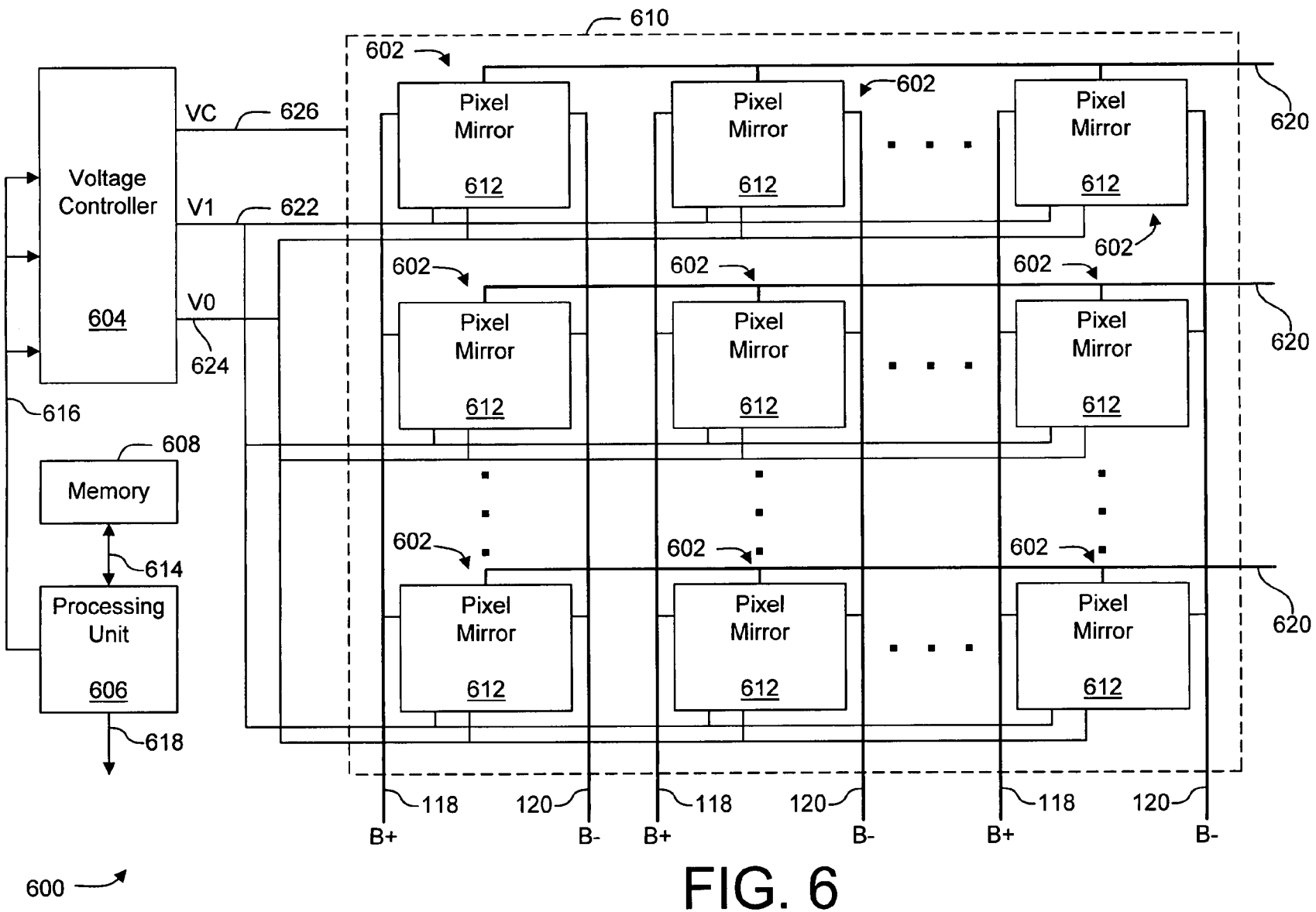
FIG. 6 shows a block diagram of a multi-pixel display in accordance with the present invention.

FIG. 6 shows a display 600 in accordance with the present invention. Display 600 includes an array of pixel cells, a voltage controller 604, a processing unit 606, a memory device 608, and a common transparent electrode 610, which overlays the entire array of pixel cells. In a particular embodiment, pixel cells 602 are formed in an integrated monolithic silicon backplane, overlaid with a plurality of pixel mirrors 612. A typical pixel array includes 768 rows and 1024 columns of pixel cells. A layer of liquid crystal material is interposed between pixel mirrors 612 and common transparent electrode 610, which is formed, for example, from Indium-Tin-Oxide.

Memory 608 is a computer readable medium (e.g., RAM, ROM, etc.) having code (e.g., data and commands) embodied therein for causing processing unit 606 to implement the various methods and driving schemes described herein. Processing unit 606 receives the data and commands from memory 608, via a memory bus 614, provides internal voltage control signals, via voltage control bus 616, to voltage controller 604, and provides data control (e.g., data into pixel array) signals via data control bus 618.

The data control aspects of processing unit 606 are not essential to a thorough understanding of the present invention, because the loading of data into pixel arrays is well known to those skilled in the art. Further, the loading of data into a liquid crystal display under the control of a processing unit is described in copending U.S. patent application Ser. No. 08/970,878, filed on Nov. 14, 1997, by Worley et al., which is incorporated herein by reference in its entirety. In brief summary, rows of data bits are asserted on bit lines 118 and 120, and then assertion of a write signal on a particular one of a plurality of word lines 620 causes the asserted bits to be written into the pixel cells of that particular row. In this manner, data bits can be sequentially written to each pixel cell of the entire display.

Responsive to control signals received from processing unit 606, via voltage control bus 616, voltage controller 604 provides predetermined voltages to pixel cells 602 via a first voltage supply terminal (V1) 622 and a second voltage supply terminal (V0) 624. Voltage controller 604 also asserts predetermined voltages on common electrode 610, via a common voltage supply terminal (VC) 626. Various embodiments of voltage controller 604 will be disclosed herein, some requiring control signals from processing unit 606, and others not. Those skilled in the art will understand that the number of control signals required in a particular embodiment will dictate the number of lines required in voltage control bus 616. Those skilled in the art will also understand that voltage controller 604, processing unit 606, and memory 608 may be disposed on or off chip with respect to the pixel array.

Figure 7:
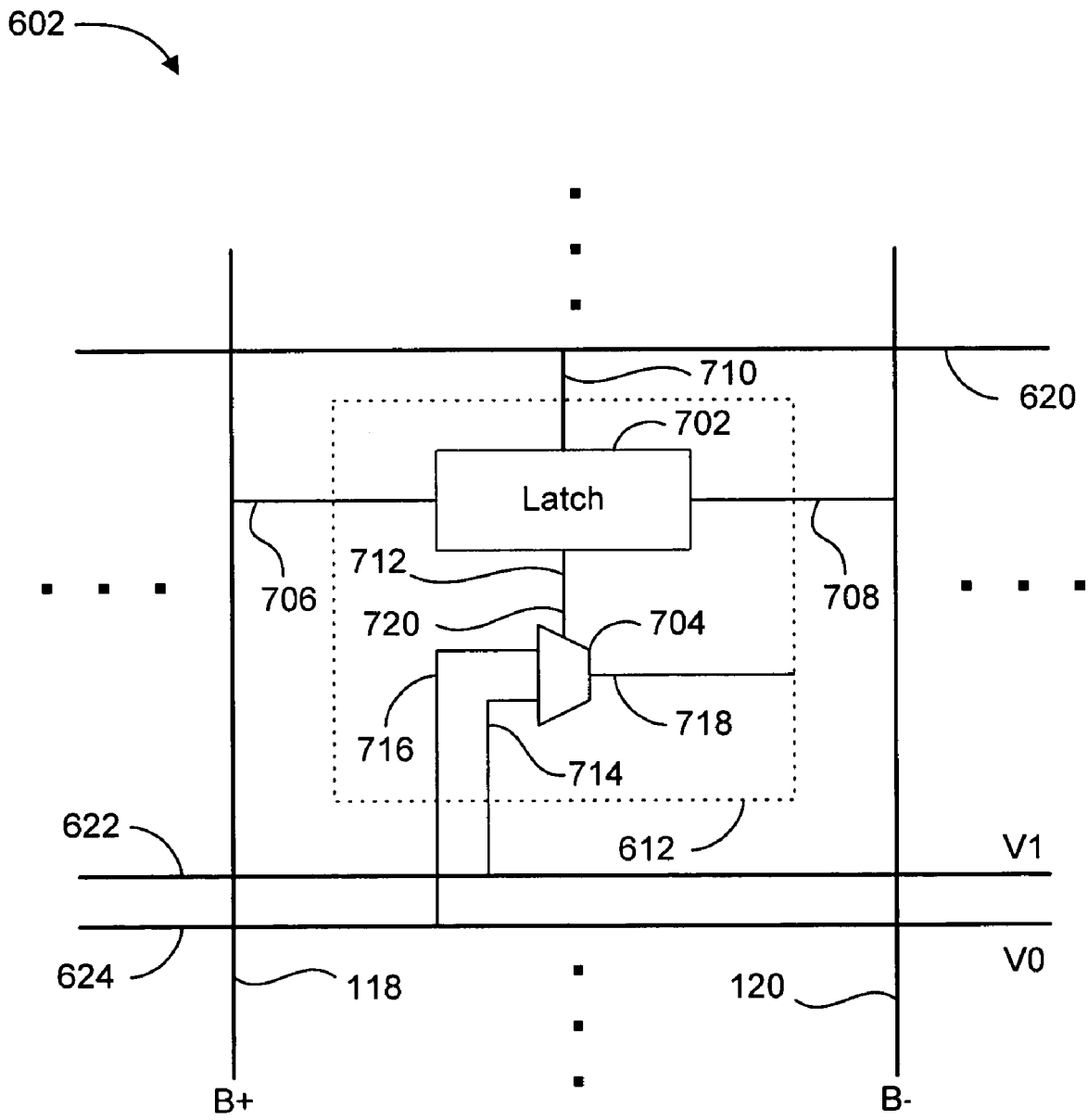
FIG. 7 details a single pixel cell of the display of FIG. 6.

FIG. 7 shows a block diagram of an exemplary pixel cell 602 of display 600 to include a storage latch 702 and a multiplexer 704. Latch 702 includes complementary input terminals 706 and 708, coupled to data lines (B+) 118 and (B−) 120, respectively, an enable terminal 710 coupled to word line 620, and a data output terminal 712. Responsive to a write signal on word line 620, latch 702 latches the data bit on output terminal 712. In this particular embodiment, latch 702 is a static-random-access (SRAM) latch, but those skilled in the art will understand that any storage element capable of receiving a data bit, storing the bit, and asserting the stored bit on output terminal 712 may be substituted for SRAM latch 702.

Multiplexer 704 includes a first input terminal 714 coupled to first voltage supply terminal (V1) 622, a second input terminal 716 coupled to second voltage supply terminal (V0) 624, an output terminal 718 coupled to pixel electrode 612 (a pixel mirror in this particular embodiment), and a control terminal 720 coupled to output terminal 712 of storage latch 702.

Thus configured, multiplexer 704, responsive to the data bit asserted on its control terminal 720, is operative to selectively couple pixel electrode 612 with first voltage supply terminal (V1) 622 and second voltage supply terminal (V0) 624. For example, if a bit having a logical high value (e.g., digital 1 or 5 volts) is stored in latch 702, then multiplexer 704 will couple pixel electrode 612 with first voltage supply terminal 622. On the other hand, if a bit having a logical low value (e.g., digital 0 or 0 volts) is stored in latch 702, then multiplexer 704 will couple pixel electrode 612 with second voltage supply terminal (V0) 624.

Figure 1:
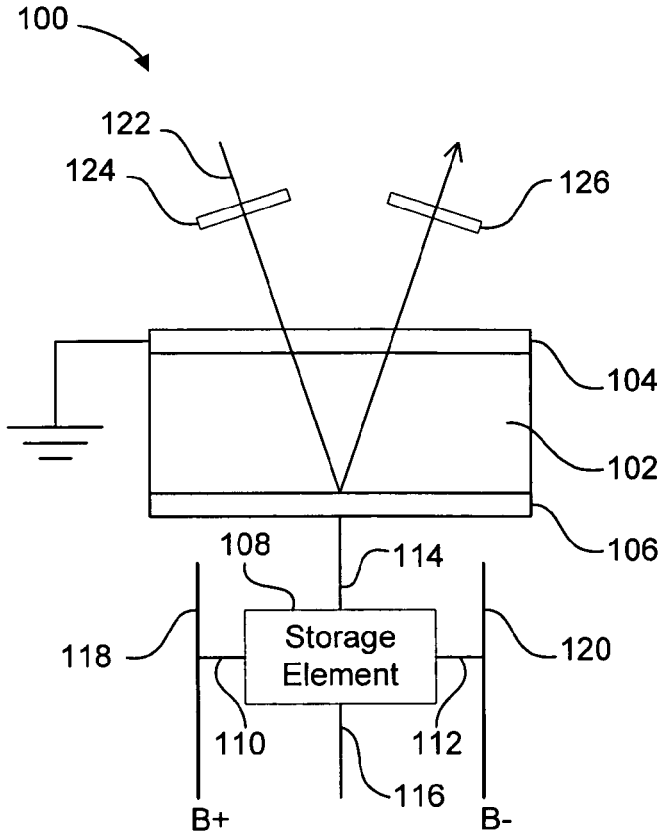
FIG. 1 Prior Art
FIG. 1 shows a block diagram of a typical liquid crystal pixel cell.
Figure 3:
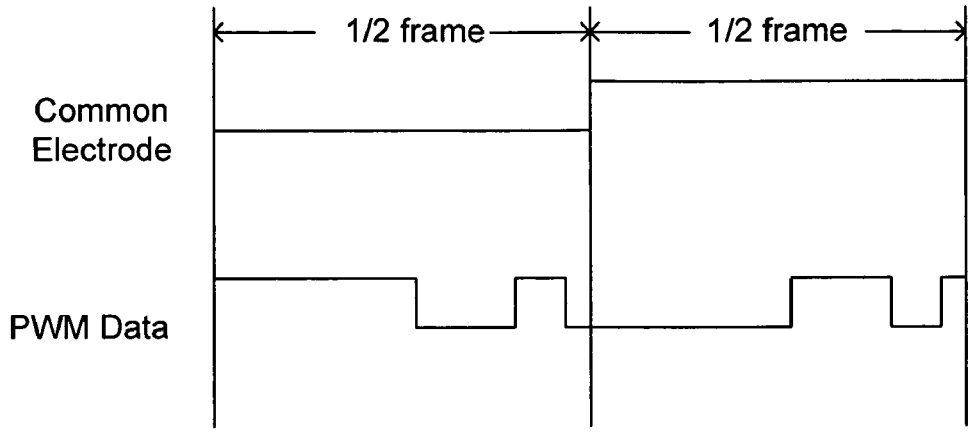
FIG. 3 Prior Art
FIG. 3 shows a split frame application of the 4-bit pulse-width-modulation data of FIG. 2 resulting in a net DC bias of 0 volts.
Figure 4:
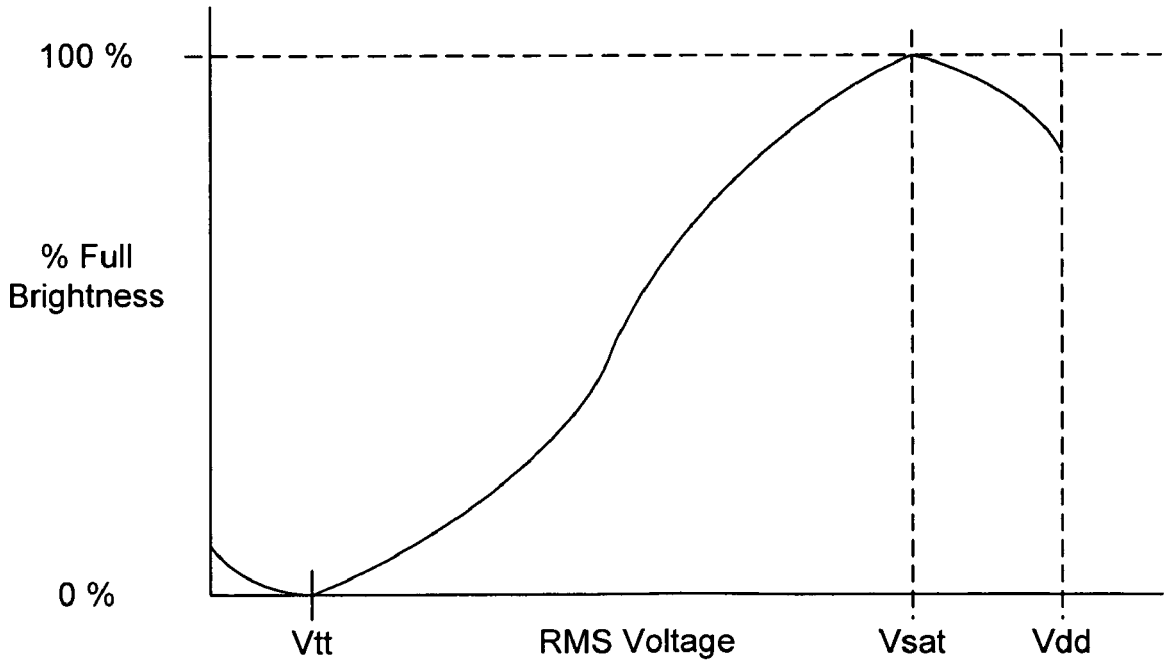
FIG. 4 Prior Art
FIG. 4 shows a typical liquid crystal intensity response versus RMS voltage curve.
Figure 5:
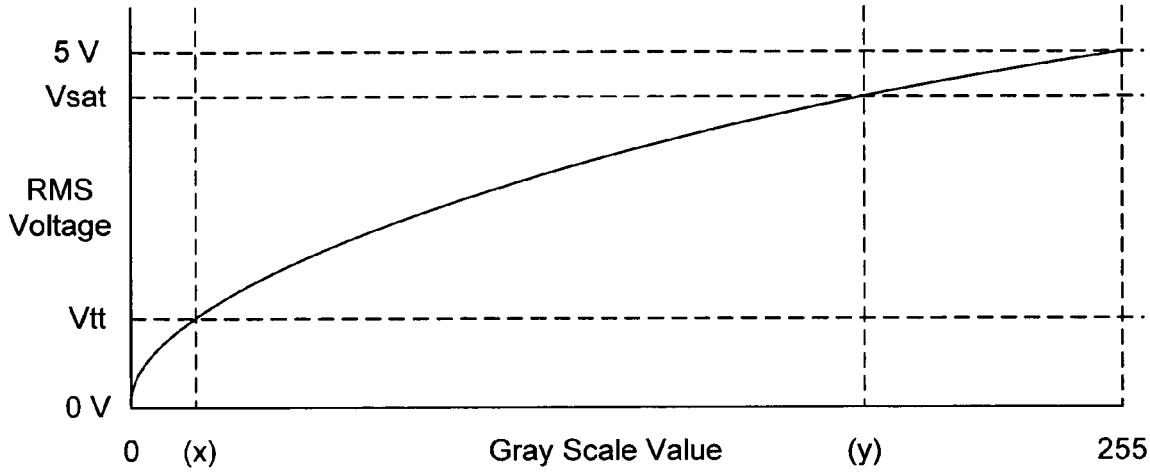
FIG. 5 Prior Art
FIG. 5 shows an RMS voltage versus 8-bit gray scale value curve.

The use of the data bits stored in latch 702 as a control means, as opposed to directly asserting the data bit on the pixel electrode (as in pixel cell 100 of FIG. 1), provides many advantages over the prior art. For example, the pixel electrodes can be driven with digital voltages higher or lower than the voltages used to drive the logic circuitry of the display, thus shortening or lengthening the time period that a particular bit must be asserted on the pixel electrodes. As another example, off states (0 volts across a pixel cell) can be asserted on the entire display at one time without changing any of the data stored in the latches of the display. Similarly, the pixel cells can be debiased (see FIG. 3) without the extra step of writing the complement of the data to the storage latches. These and other advantages of the present invention will be apparent to those skilled in the art, particularly in view of this disclosure.

Figure 8:
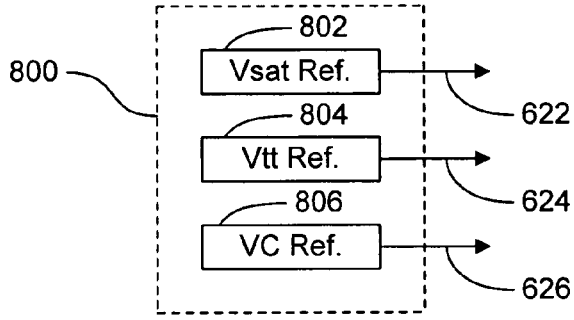
FIG. 8 shows a block diagram of one embodiment of a voltage controller of FIG. 7.

FIG. 8 is a block diagram of an alternate voltage controller 800, which requires no control signals from processing unit 606. Voltage controller 800 includes a saturation voltage (Vsat) reference 802, a threshold voltage (Vtt) reference 804, and a common voltage (VC) reference 806. Each of the reference voltages 802, 804, and 806, may be generated on chip, or may simply be connection terminals for receiving the reference voltages from an off chip source. Regardless of the source of the reference voltages 802, 804, and 806, the assertion of these voltages on first voltage supply terminal 622, second voltages supply terminal 804, and common voltage supply terminal 626, respectively, are deemed to be within the functional definition of voltage controller 800.

Figure 2:
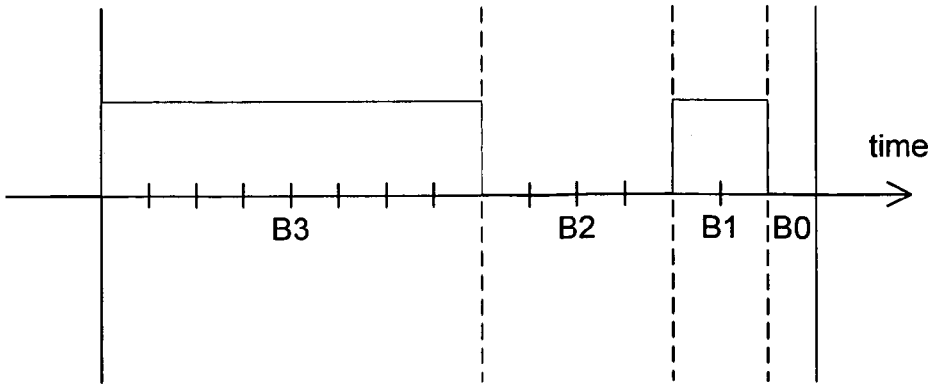
FIG. 2 Prior Art
FIG. 2 shows one frame of a 4-bit binary-weighted pulse-width-modulation data.
Figure 9:
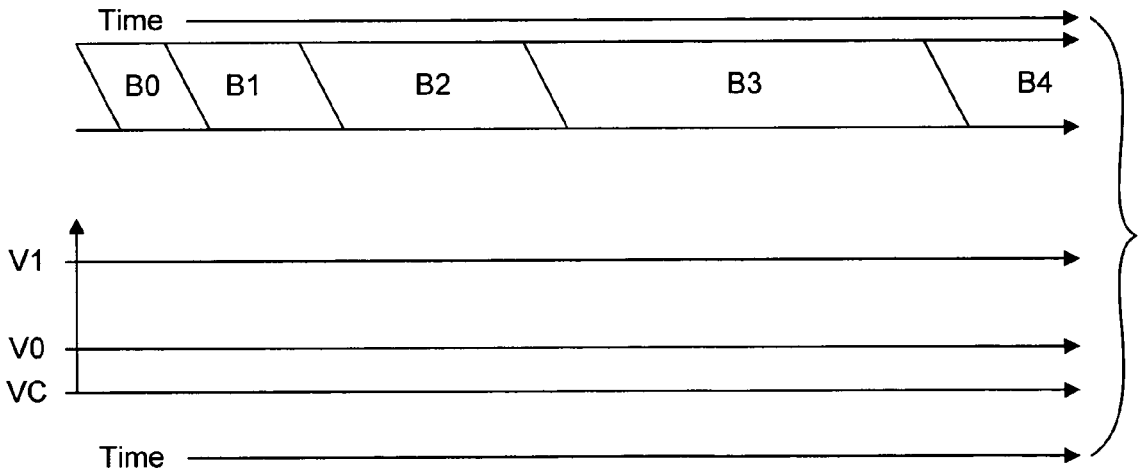
FIG. 9 shows a timing diagram for writing a number of binary weighted data bits to one embodiment of the display of FIG. 6.

FIG. 9 is a timing diagram showing the writing of several data bits (B0-B4) to display 600, while voltage controller 800 asserts Vsat, Vtt, and VC on first voltage supply terminal 622, second voltage supply terminal 624, and common voltage supply terminal, respectively. Note that bits (B0-B4) are binary weighted bits, as explained above with reference to FIG. 2, so the time period that each bit is asserted on display 600 is dependent on the significance of the particular bit, even though the entire duration of bit B4 is not shown, and other bits may be displayed following bit B4.

Additionally, writing a bit, for example bit B0, to display 600 should be understood to mean writing one bit of significance B0, of each of a plurality of multi-bit data words, to each of a plurality of the storage elements (latches) of display 600. Thus, B0 refers to the significance of a particular bit of a multi-bit data word, and bit B0 of any particular multi-bit data word may have either a logical high or logical low value. The diagonal lines in the data portion of the timing diagram of FIG. 9 indicate that it takes a finite amount of time to write the particular values of each bit (e.g., B0) to each storage element of display 600.

Figure 10:
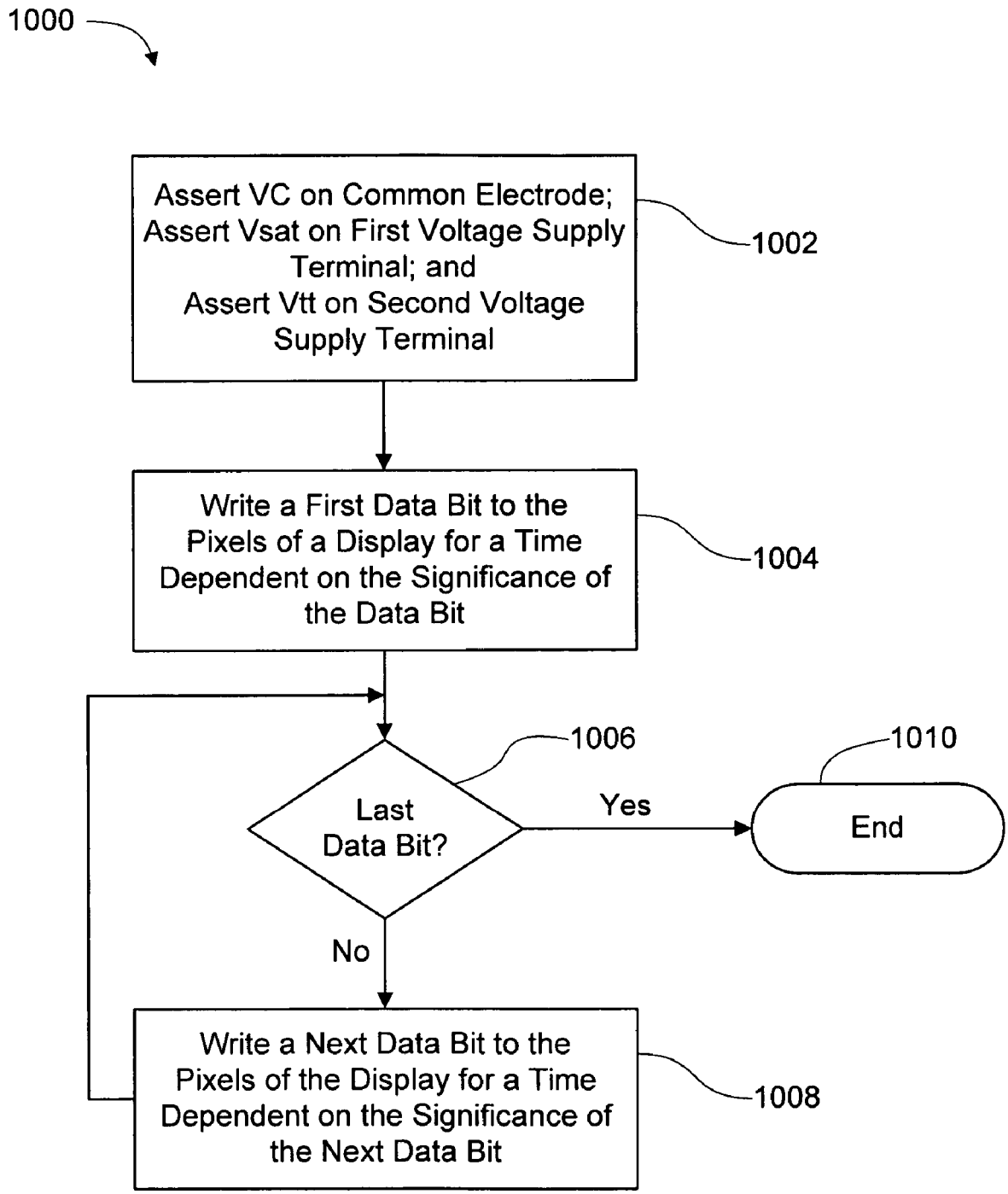
FIG. 10 is a flow chart summarizing a method for implementing the timing diagram of FIG. 9.

FIG. 10 is a flow chart summarizing a method 1000 for driving display 600 with voltage controller 800 in accordance with the driving scheme shown in FIG. 9. In a first step 1002, voltage controller 800 asserts VC, via common voltage supply terminal 626, on common electrode 610, asserts Vsat on first voltage supply terminal 622, and asserts Vtt on second voltage supply terminal 624. Next, in a second step 1004 a first bit (e.g., B0) is written to the storage elements 702 of display 600 for a time period dependent on the significance of the first data bit. In a next step 1006, it is determined whether the previously displayed bit was the last bit to be displayed. If not, then in a fourth step 1008, a next data bit is written to the storage elements 702 of display 600 for a time period dependent on the significance of the next bit. Steps 1006 and 1008 are repeated until in the third step 1006, it is determined that the last data bit has been displayed for a time dependent on its significance, afterwhich, in a tenth step 1010, method 1000 ends.

Figure 11:
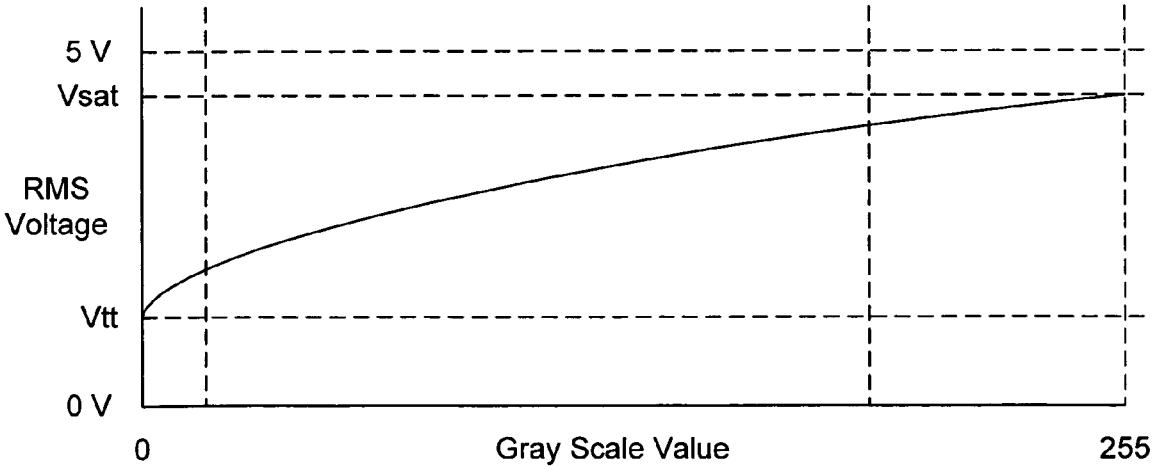
FIG. 11 is an RMS voltage versus gray scale value curve modified in accordance with the present invention to confine the gray scale values to the useful range of RMS voltages.

FIG. 11 shows the results of method 1000 of multiplexing the actual saturation voltage (Vsat) and threshold voltage (Vtt) onto the pixel electrodes of display 600 as binary weighted pulse-width-modulation data. In particular, the RMS voltage versus gray scale value curve is shifted such that a gray scale value of 0 corresponds to an RMS voltage of Vtt (completely dark), and a gray scale value of 255 corresponds to an RMS voltage of Vsat (full intensity).

Although voltage controller 800 used in conjunction with method 1000 is able to conform the gray scale values to the useful portion of the display response curve, method 1000 does not, by itself, provide all of the beneficial results of the present invention. In particular, method 1000 does not provide for debiasing the pixel cells of display 600 or make allowance for the fact that data must be written to the entire display in the relatively short least-significant-bit (LSB) time.

Figures 12A, 12B:
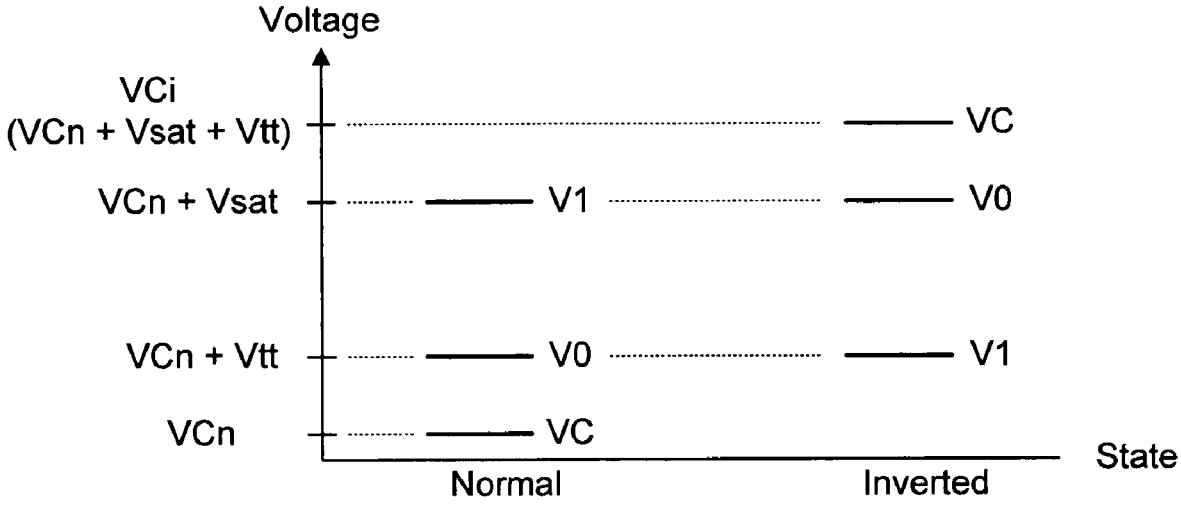
FIG. 12A is a voltage chart that shows a modulation scheme and debias scheme for use with one embodiment of the present invention.
FIG. 12B is a chart showing sample values of the voltages shown in FIG. 12A.

FIG. 12A shows a voltage scheme which provides for both modulation and debiasing of display 600 in accordance with the present invention. Both the normal state and the inverted states contribute to the RMS modulation of the pixel cells, but the normal and inverted states balance each other to insure a net DC bias of 0 volts across the cell. In the normal state, voltage controller 604 asserts a first predetermined voltage (VCn+Vsat) on first voltage supply terminal (V1) 622, a second predetermined voltage (VCn+Vtt) on second voltage supply terminal (V0) 624, and a third predetermined voltage (VCn) on common voltage supply terminal 626. In the inverted (debias) state, the voltage controller 604 asserts a fourth predetermined voltage on the first voltage supply terminal 622, a fifth predetermined voltage on the second voltage supply terminal 624, and a sixth predetermined voltage on the common voltage supply terminal 626. In the inverted (debias) state, the voltage differences between the various voltage supply terminals 622, 624, and 626 must be equal in magnitude but opposite in polarity to the respective voltage differences in the normal state, in order to maintain a net DC bias of 0 volts across the pixel cells of the display.

The voltage scheme of FIG. 12A advantageously reduces the number of required voltages on the display chip from six to four. According to this particular scheme, the first predetermined voltage is defined to be equal to the fifth predetermined voltage, and the second predetermined voltage is defined to be equal to the fourth predetermined voltage. Then, in order to maintain the modulation and debias conditions, all that is required is that the difference between the third predetermined voltage and the second predetermined voltage be equal in magnitude but opposite in polarity to the voltage difference between the sixth predetermined voltage and the fifth predetermined voltage. In this particular case, the difference between the fourth predetermined voltage and the fifth predetermined voltage is equal to Vtt.

FIG. 12B is a chart providing example values of voltages in accordance with the scheme of FIG. 12A for a liquid crystal display having a threshold voltage of 1 volt and a saturation voltage of 3 volts. The common voltage during the normal phase (VCn) is arbitrarily selected to be the 0 volt reference. During the normal modulation phase, (V1*n*) has a value of 3 volts (VCn+Vsat) and (V2*n*) has a value of 1 volt (VCn+Vtt). During the inverted debias phase, the values of (V1) and (V0) are interchanged such that (V1*i*) has a value of 1 volt and (V2*i*) has a value of 3 volts. In order to maintain the required voltage relationships, (VCi) is set at 4 volts (V0*i*+Vtt).

Figure 13:
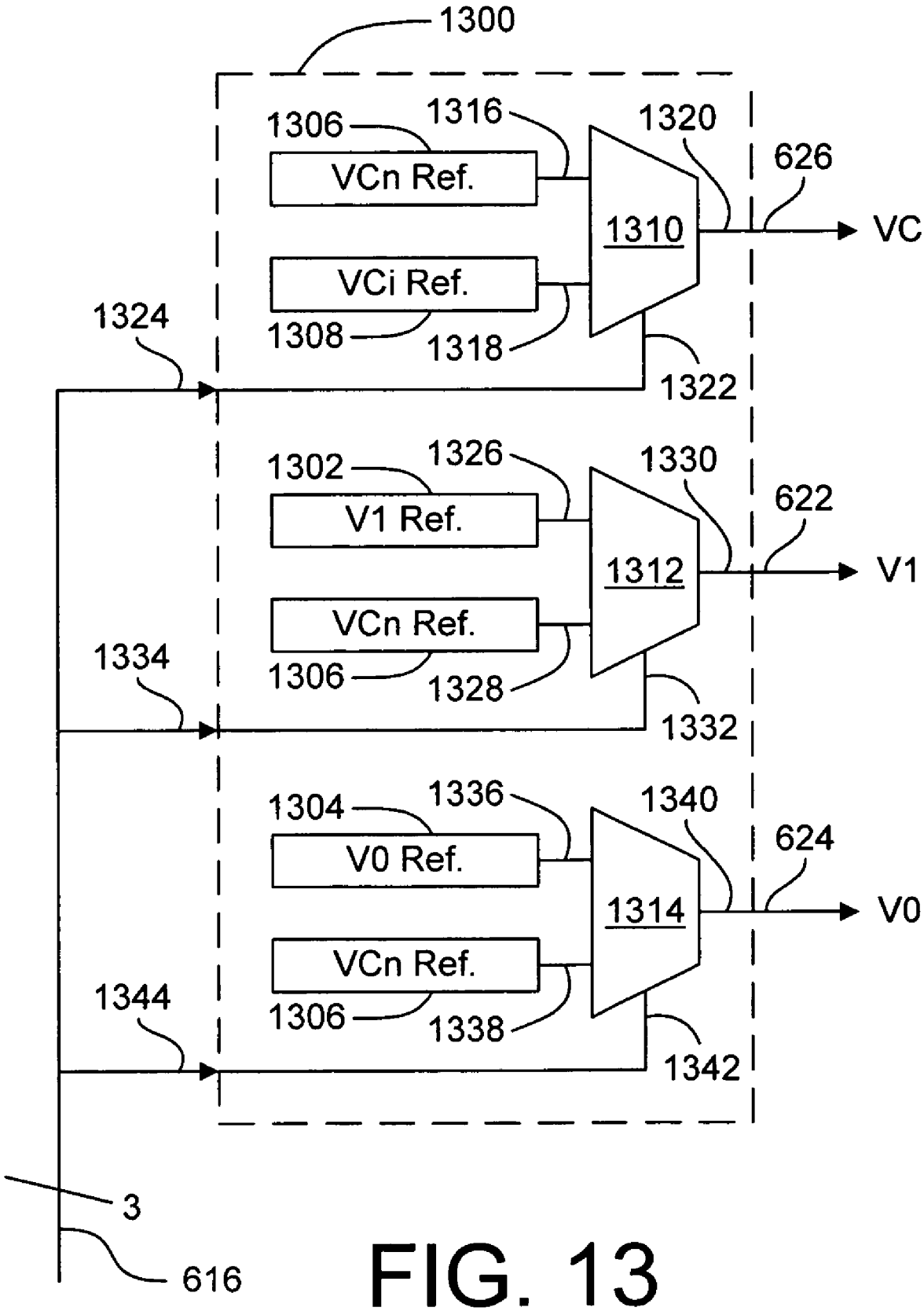
FIG. 13 is a block diagram of an alternate voltage controller for implementing a particular driving scheme in accordance with the present invention.

FIG. 13 is a block diagram of an alternate voltage controller 1300 capable of implementing the voltage scheme of FIG. 12A in conjunction with display 600. Voltage controller 1300 includes a first voltage source 1302 for providing a (V1) reference voltage, a second voltage source 1304 for providing a (V0) reference voltage, a third voltage source 1306 for providing a normal state common (VCn) reference voltage, and a fourth voltage source 1308 for providing an inverted state common (VCi) reference voltage. Although voltage source 1306 appears three times in FIG. 13, it is actually a single voltage source which is shown repeatedly for the sake of clarity. Each of voltage sources 1302, 1304, 1306, and 1308 may be on chip voltage generators, or may simply be contact terminals for receiving the respective voltages from an external source.

Voltage controller 1300 further includes a first multiplexer 1310, a second multiplexer 1312, and a third multiplexer 1314. First multiplexer 1310 has a first input terminal 1316 coupled to VCn voltage source 1306, a second input terminal 1318 coupled to VCi voltage source 1308, an output terminal 1320 coupled to common voltage supply terminal 626, and a control terminal 1322 coupled to a common electrode control line 1324 of voltage control bus 616. Second multiplexer 1312 has a first input terminal 1326 coupled to V1 voltage source 1302, a second input terminal 1328 coupled to VCn voltage source 1306, an output terminal 1330 coupled to first voltage supply terminal 622, and a control terminal 1332 coupled to a V1 control line 1334 of voltage control bus 616. Third multiplexer 1314 has a first input terminal 1336 coupled to V0 voltage source 1304, a second input terminal 1338 coupled to VCn voltage source 1306, an output terminal 1340 coupled to second voltage supply terminal 624, and a control terminal 1342 coupled to a V0 control line 1344 of voltage control bus 616.

Voltage controller 1300 operates under the control of processing unit 606 (FIG. 6) as follows. Responsive to a control signal received via VC control line 1324, multiplexer 1310 selectively asserts one of reference voltages VCn or VCi onto common voltage supply terminal 626 and, therefore, common electrode 610. Similarly, responsive to a control signal received via V1 control line 1334, multiplexer 1312 selectively asserts one of reference voltages V1 or VCn onto first voltage supply terminal 622, and thus onto the pixel electrodes 612 of all pixel cells 602 of display 600 currently storing a particular digital value (e.g., logical high) in their respective latches 702. Additionally, responsive to a control signal received via V0 control line 1344, multiplexer 1314 selectively asserts one of reference voltages V0 or VCn onto second voltage supply terminal 624, and thus onto the pixel electrodes 612 of all pixel cells 602 of display 600 currently storing another digital value (e.g., logical low) in their respective latches 702.

The ability to assert predetermined voltages, via voltage supply terminals 622 and 624, onto the pixel electrodes 612 of display 600 while the data stored in the display remains unchanged provides great flexibility in driving display 600. Additionally, by simultaneously asserting the same voltage (e.g., VCn) on each of voltage supply terminals 622, 624, and 626, voltage controller 1300 can rapidly assert an off state on every pixel cell of display 600 without affecting the data contained therein.

Figure 14:
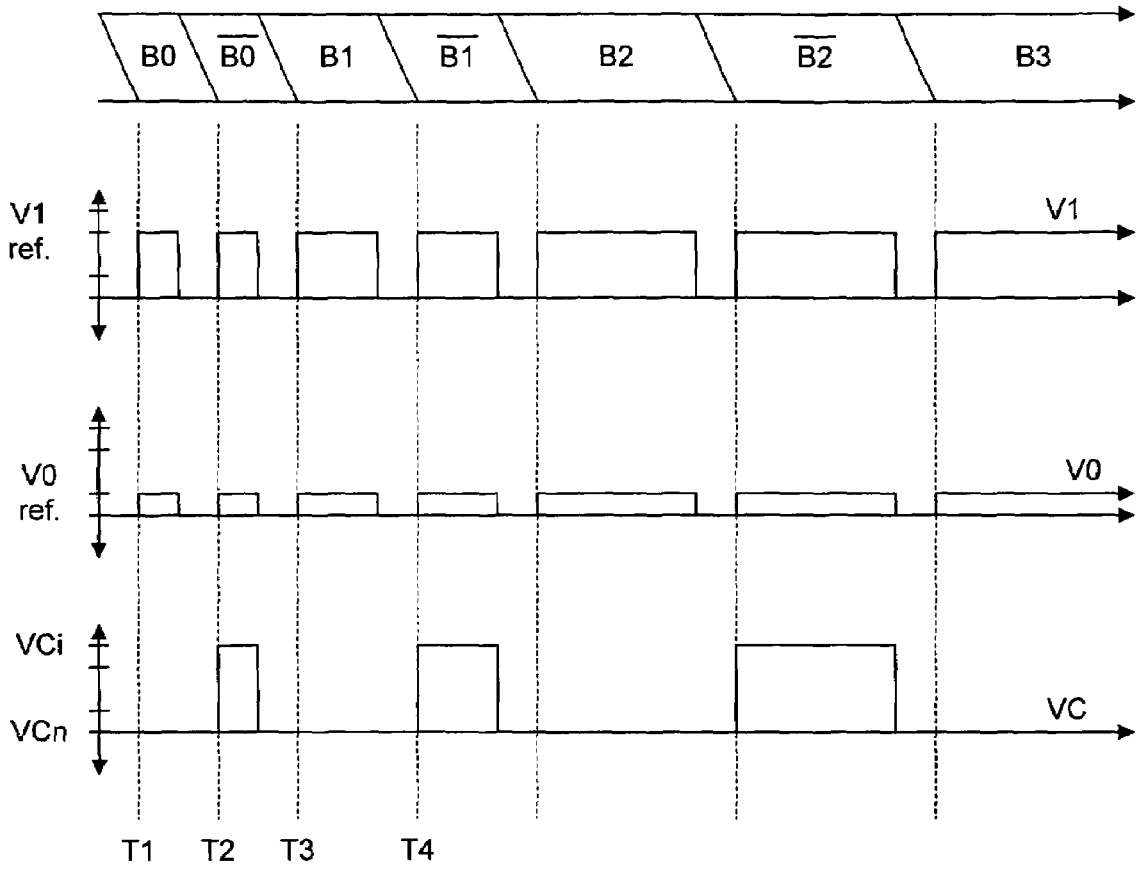
FIG. 14 is a timing diagram showing an implementation of the voltage scheme of FIG. 12A.

FIG. 14 is a timing diagram showing how the voltage scheme of FIG. 12 may be implemented in display 600 with voltage controller 1300. Initially, voltage controller 1300 asserts an off state on display 600 by simultaneously asserting a same voltage (VCn) on first voltage supply terminal 622, second voltage supply terminal 624, and common voltage supply terminal 626. While the off state is being asserted on display 600, bits B0 are written to the storage latches 702 of each pixel cell 602. Then, at a time T1, voltage controller 1300 asserts reference voltage V1 on first voltage supply terminal 622 and reference voltage V0 on second voltage supply terminal 624, each for a modulation time period dependent on the significance of bit B0. Immediately thereafter, voltage controller 1300 asserts another off state on display 600, during which time the complements of bits B0 are written to the latches 602 of display 600. Next, at a time T2, voltage controller 1300 asserts reference voltage V1 on first voltage supply terminal 622, reference voltage V0 on second voltage supply terminal 624, and reference voltage VCi on common voltage supply terminal 626 for a time period equal to the modulation time period.

The loading of the complementary bits into display 600 and the reassertion of reference voltages V1, V0, and VCi on the respective voltage supply terminals debiases the pixel cells as follows. First, replacing each bit in display 600 with its complement effectively interchanges reference voltage V1 with reference voltage V0, as described with respect to FIG. 12A. Second, reference voltage VCi is selected such that the voltage difference between VCn and V0 is equal in magnitude but opposite in polarity to the voltage difference between VCi and V1. Therefore, the voltage across a pixel cell storing a particular bit is equal in magnitude but opposite in polarity to the voltage across the pixel cell when storing the complement of the bit. It is important to note that the debiasing step also contributes to the RMS voltage generated across each pixel cell, and must therefore be considered when determining the appropriate time interval for a bit of a particular significance.

Voltage controller asserts another off state on display 600 while bit B1 is written to display 600. Then, at a time T3, voltage controller 1300 asserts reference voltage V1 on first voltage supply terminal 622 and reference voltage V0 on second voltage supply terminal 624, all for a second modulation time period dependent on the significance of bit B1. Immediately thereafter, voltage controller 1300 asserts another off state on display 600, during which time the complements of bits B1 are written to display 600. Then, at a time T4, voltage controller 1300 asserts reference voltage V1 on first voltage supply terminal 622, reference voltage V0 on second voltage supply terminal 624, and reference voltage VCi on common voltage supply terminal 626 for a time period equal to the second modulation time period. The remaining data bits and their complements are written to display 600, and the reference voltages are asserted on their respective voltage supply terminals for periods of time depending on their respective significance, as described above with respect to bits B0 and B1.

Figure 15:
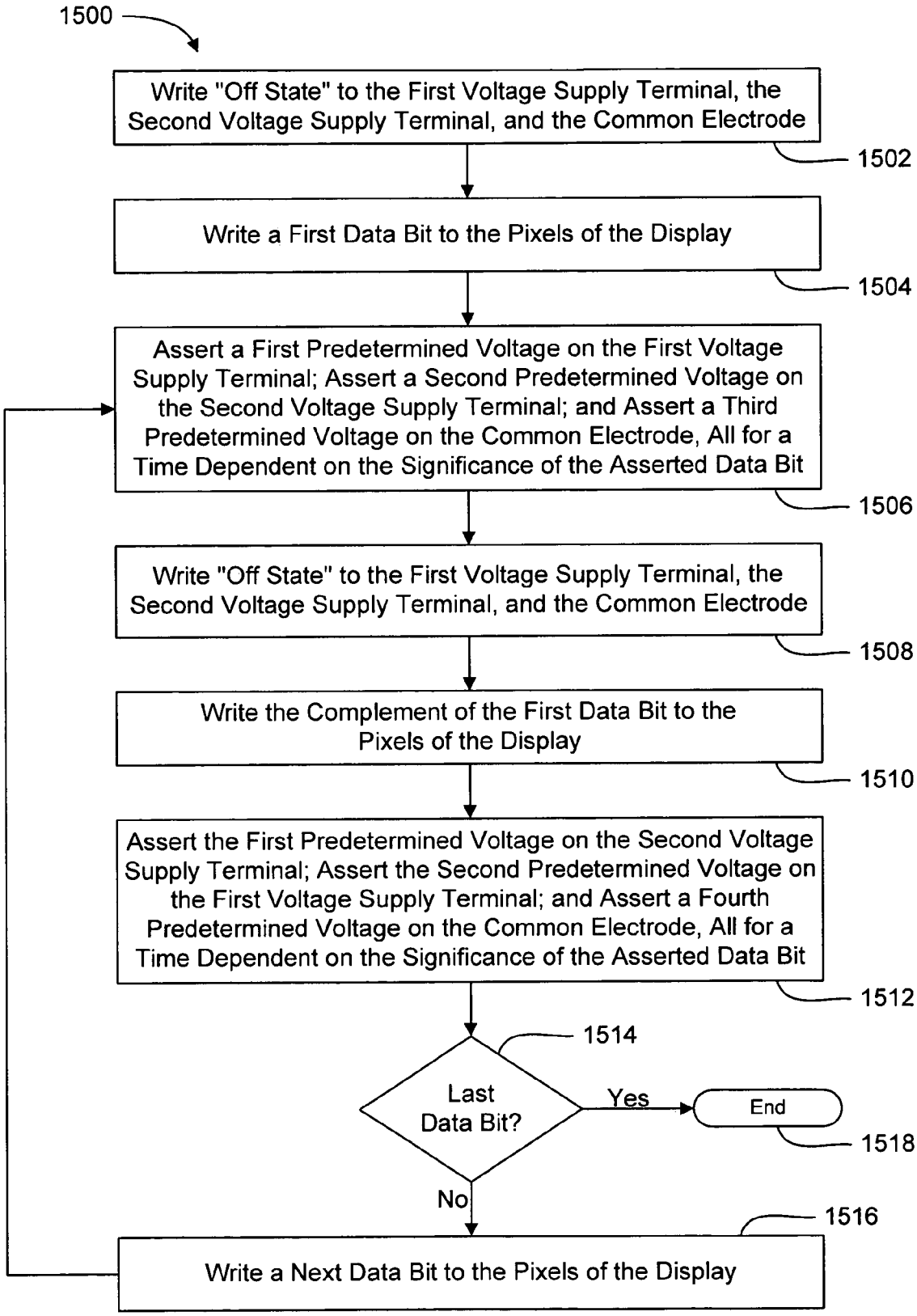
FIG. 15 is a flow chart summarizing the method of the driving scheme of FIG. 13.

FIG. 15 is a flow chart summarizing a method 1500 for driving a display in accordance with the voltage scheme of FIG. 12A. In a first step 1502, voltage controller 1300 asserts an off state (a same voltage) to first voltage supply terminal 622, to second voltage supply terminal 624, and common electrode 610. Next, in a second step 1504, a first data bit is written to pixel cells 602 of display 600. Then, in a third step 1506, voltage controller 1300 asserts a first predetermined voltage on first voltage supply terminal 622, a second predetermined voltage on second voltage supply terminal 624, and a third predetermined voltage on common electrode 610, all for a time dependent on the significance of the first data bit. In a fourth step 1508, voltage controller 1300 asserts an off state to display 600, and then in a fifth step 1510, the complement of the first data bit is written to pixel cells 602 of display 600. Next, in a sixth step, voltage controller 1300 asserts the first predetermined voltage on second voltage supply terminal 624, asserts the second predetermined voltage on first voltage supply terminal 622, and asserts a fourth predetermined voltage on common electrode 610, all for a time period dependent on the significance of the stored data bit. In a seventh step 1514, if the last data bit has not been written to display 600, then in an eighth step 1516, a next data bit is written to the pixels of the display, and method 1500 returns to third step 1506. If, however, in seventh step 1514, it is determined that the last data bit has been written to display 600, then in a ninth step 1518 method 1500 ends.

Figure 16:
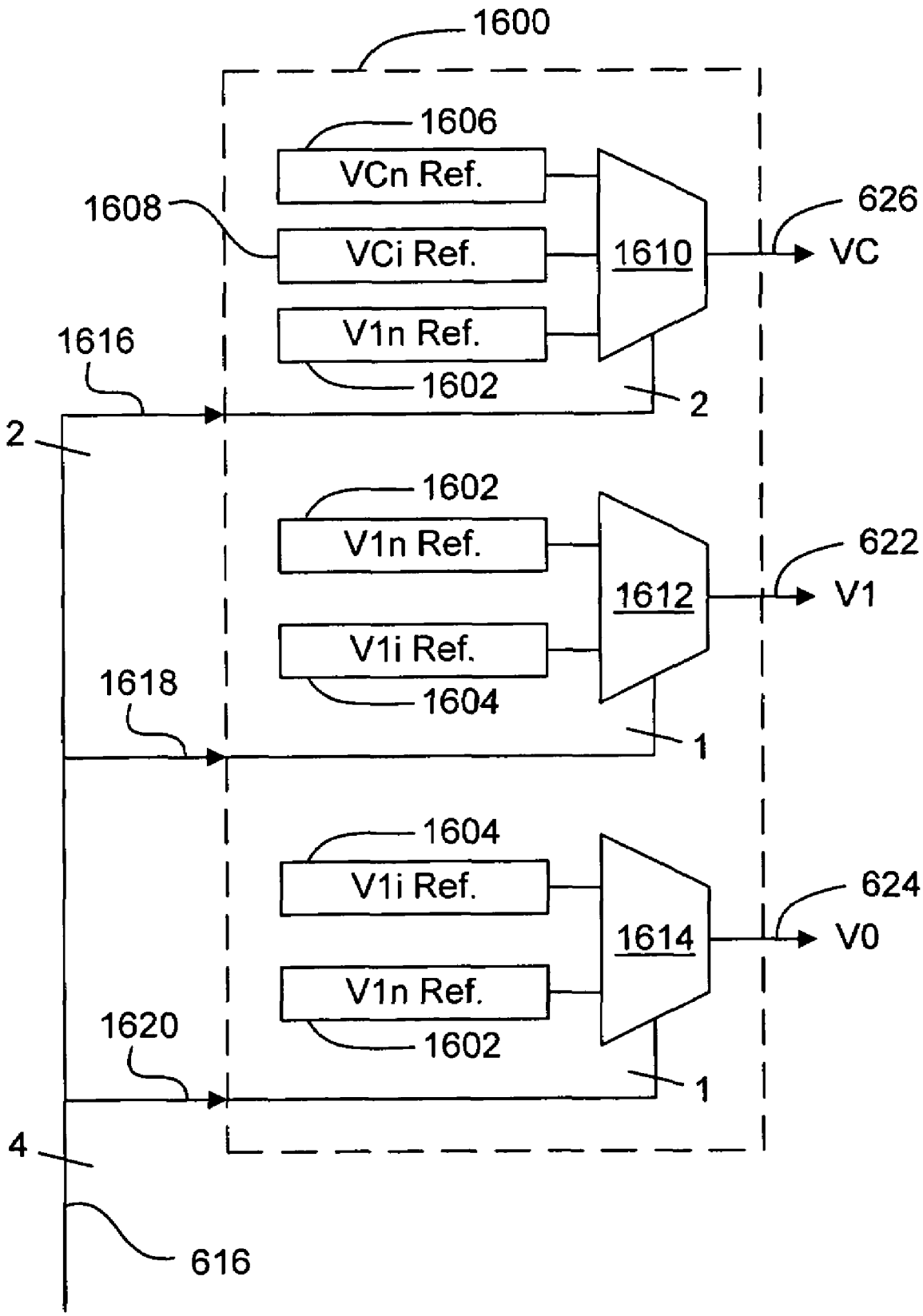
FIG. 16 is a block diagram of an alternate voltage controller for implementing a particular driving scheme in accordance with the present invention.

FIG. 16 is a block diagram of an alternate voltage controller 1600 capable of implementing the voltage scheme of FIG. 12A in conjunction with display 600, without the need to write complementary data bits to display 600. Voltage controller 1600 includes a first voltage source 1602 for providing a (V1*n*) reference voltage, a second voltage source 1604 for providing a (V1*i*) reference voltage, a third voltage source 1606 for providing a normal state common (VCn) reference voltage, and a fourth voltage source 1608 for providing an inverted state common (VCi) reference voltage. Although voltage source (V1*i*) 1604 appears twice in FIG. 16, it is actually a single voltage source which is shown repeatedly for the sake of clarity. Similarly, voltage source (V1*n*) 1602, shown three times, is also a single voltage source. Additionally, because voltage (V1*i*) is equal to voltage (V0*n*), and voltage (V1*n*) is equal to voltage (V0*i*) according to the voltage scheme of FIG. 12A, it is not necessary to show separate voltage sources for voltages (V0*n*) and (V0*i*). Each of voltage sources 1602, 1604, 1606, and 1608 may be on chip voltage generators, or may simply be contact terminals for receiving the respective voltages from an external source.

Voltage controller 1600 further includes a first multiplexer 1610, a second multiplexer 1612, and a third multiplexer 1614. First multiplexer 1610 has a first input terminal coupled to VCn voltage source 1606, a second input terminal coupled to VCi voltage source 1608, a third input terminal coupled to V1*n* voltage source 1602, an output terminal coupled to common voltage supply terminal 626, and a 2-bit control terminal set coupled to a 2-bit common electrode control line 1616 of voltage control bus 616. Second multiplexer 1612 has a first input terminal coupled to V1*n* voltage source 1602, a second input terminal coupled to V1*i* voltage source 1604, an output terminal coupled to first voltage supply terminal 622, and a control terminal coupled to a V1 control line 1618 of voltage control bus 616. Third multiplexer 1614 has a first input terminal coupled to V1*i* voltage source 1604, a second input terminal coupled to V1*n* voltage source 1602, an output terminal coupled to second voltage supply terminal 624, and a control terminal coupled to a V0 control line 1620 of voltage control bus 616.

Voltage controller 1600 operates under the control of processing unit 606 (FIG. 6) as follows. Responsive to a control signal received via 2-bit VC control line 1616, multiplexer 1610 selectively asserts one of reference voltages VCn, VCi, or V1*i* onto common voltage supply terminal 626 and, therefore, common electrode 610. Similarly, responsive to a control signal received via V1 control line 1618, multiplexer 1612 selectively asserts one of reference voltages V1*n* or V1*i* onto first voltage supply terminal 622, and thus onto the pixel electrodes 612 of all pixel cells 602 of display 600 currently storing a particular digital value (e.g., logical high) in their respective latches 702. Additionally, responsive to a control signal received via V0 control line 1620, multiplexer 1614 selectively asserts one of reference voltages V1*i* or V1*n* onto second voltage supply terminal 624, and thus onto the pixel electrodes 612 of all pixel cells 602 of display 600 currently storing another digital value (e.g., logical low) in their respective latches 702. Voltage controller 1600 has an advantage over voltage controller 1300 in that voltage controller 1600 can assert both voltages V1*n* and V1*i* on either of voltage supply terminals 622 or 624, thus eliminating the need to write complementary data bits to display 600 to achieve debiasing of the pixel cells.

Figure 17:
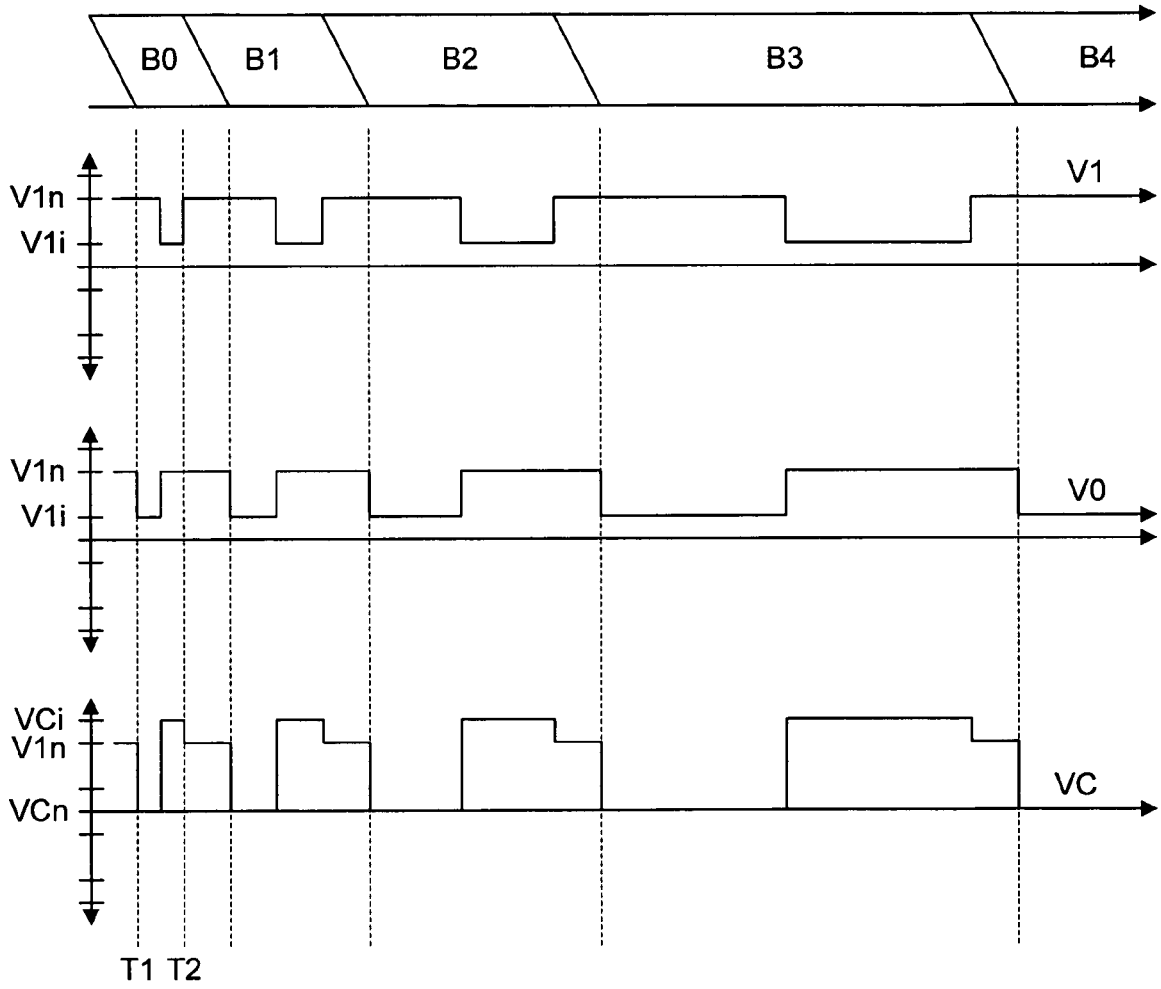
FIG. 17 is a timing diagram showing an implementation of the voltage scheme of FIG. 12A.

FIG. 17 is a timing diagram showing an implementation of the voltage scheme of FIG. 12A with voltage controller 1600. Initially, voltage controller 1600 asserts an off state on display 600 by asserting a same voltage (i.e., (V1*n*)) on each of first voltage supply terminal 622, second voltage supply terminal 624, and common voltage supply terminal 626. While the off state is asserted on display 600, bit B0 is written to display 600. Then, at a time T1, voltage controller 1600 asserts voltage (V1*n*) on first voltage supply terminal 622, voltage (V1*i*) on second voltage supply terminal 624, and voltage (VCn) on common voltage supply terminal 626. Then, after a period of time dependent on the significance of the bit (B0) stored in display 600, voltage controller 1600 switches to debias mode, with bit B0 still stored in the latches 702 of display 600, by asserting voltage (V1*i*) on first voltage supply terminal 622, voltage (V1*n*) on second voltage supply terminal 624, and voltage (VCi) on common voltage supply terminal 626, for the same period of time dependent on the significance of the stored bit B0. Afterwards, at a time T2, voltage controller 1600 writes an off state to display 600 so that the next bit (B1) can be written to display 600. The modulation and debiasing of display 600 for the remaining bits occurs substantially as described for bit B0, except that the time periods that voltage controller 1600 asserts the various reference voltages on the respective voltage supply terminals varies according to the significance of the particular bits written to display 600.

Figure 18:
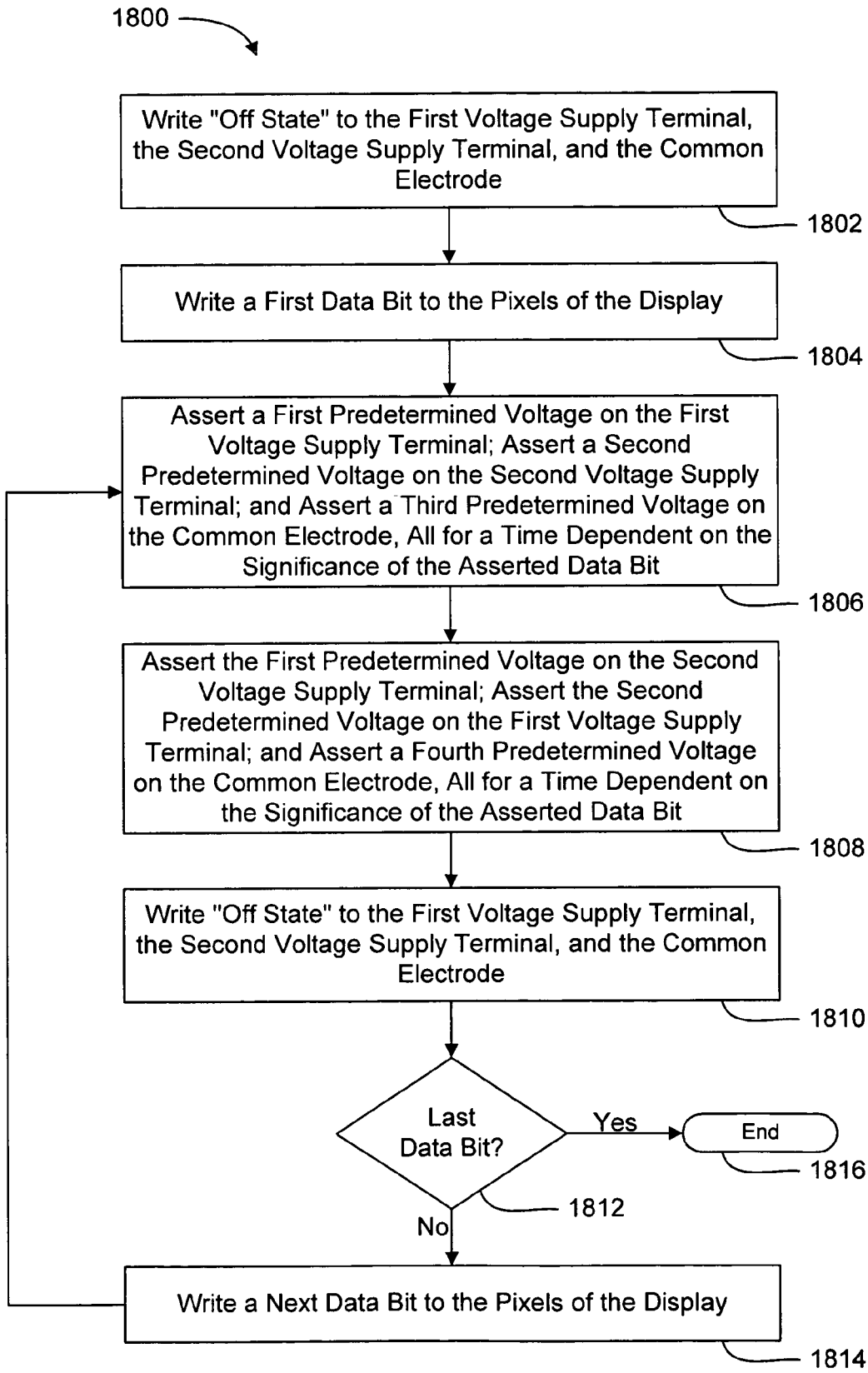
FIG. 18 is a flow chart summarizing a method for driving the display of FIG. 6 in accordance with the driving scheme of FIG. 17.

FIG. 18 is a flow chart summarizing an alternate method 1800 for driving a display in accordance with the voltage scheme of FIG. 12A. In a first step 1802, voltage controller 1600 writes an off state to display 600. Then, in a second step 1804, a first data bit is written to pixel cells 602 of display 600. In a third step 1806, voltage controller 1600 asserts a first predetermined voltage (V1*n*) on first voltage supply terminal 622, a second predetermined voltage (V1*i*) on second voltage supply terminal 624, and a third predetermined voltage (VCn) on common electrode 610, all for a time period dependent on the significance of the data bit written to display 600. Next, in a fourth step 1808, voltage controller 1600 asserts the first predetermined voltage (V1*n*) on second voltage supply terminal 624, the second predetermined voltage (V1*i*) on first voltage supply terminal 622, and a fourth predetermined voltage on common electrode 610, all for a time period equal to the time period dependent on the significance of the data bit written to display 600. In a fifth step 1810, voltage controller 1600 writes another off state to display 600. In a sixth step 1812, if the last data bit has not been written to display 600, then in a seventh step 1814, a next data bit is written to display 600, and method 1800 returns to the third step 1806. If, in the sixth step 1812, the last bit had been written to display 600, then in an eighth step 1816, method 1800 ends.

Figures 19A, 19B:
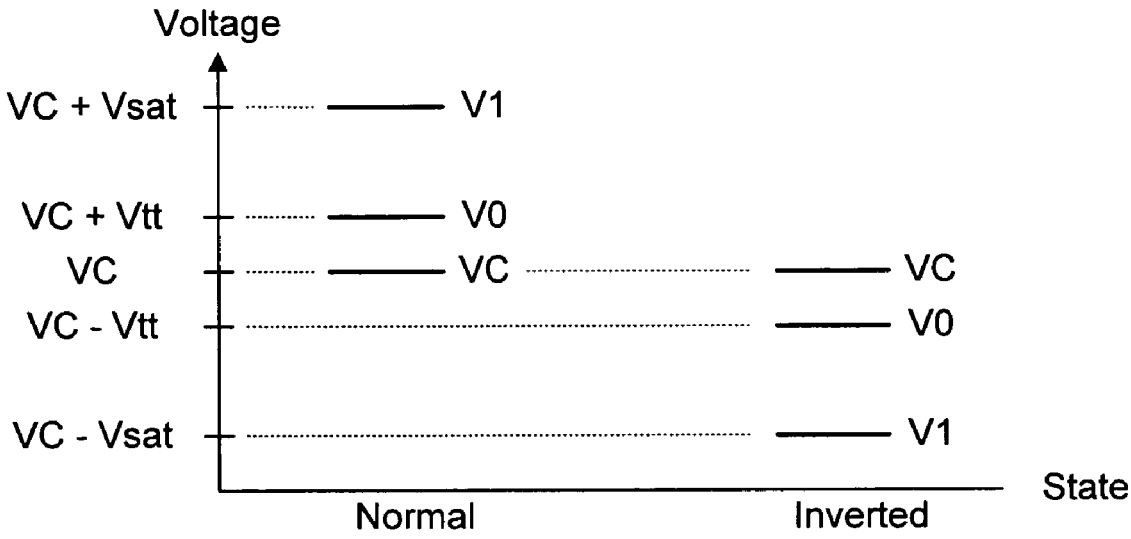
FIG. 19A is a voltage chart that shows a modulation scheme and debias scheme for use with one embodiment of the present invention.
FIG. 19B is a chart showing sample values of the voltages shown in FIG. 19A.

FIG. 19A is a chart illustrating an alternate voltage scheme for use in accordance with the present invention, wherein common electrode 610 is maintained at the same voltage (VC) during both the normal and inverted debiasing states. The voltages asserted on first voltage supply terminal 622 and second voltage supply terminal 624 are toggled about VC in order to modulate and debias the pixel cells of display 600. In particular, during the normal state, a first predetermined reference voltage (VC) is asserted on common voltage supply terminal (VC) 626, a second predetermined reference voltage (VC+Vsat) is asserted on first voltage supply terminal (V1) 622, and a third predetermined reference voltage (VC+Vtt) is asserted on second voltage supply terminal (VO) 624. During the inverted (debias) state, the first predetermined voltage (VC) is asserted on common voltage supply terminal (VC) 626, a fourth predetermined voltage (VC−Vsat) is asserted on first voltage supply terminal (V1) 622, and a fifth predetermined voltage (VC−Vtt) is asserted on second voltage supply terminal (V0) 624. The voltage scheme of FIG. 19A beneficially eliminates the need to drive the voltage on common electrode 610, but requires a greater number of voltages (i.e., 4) to drive first voltage supply terminal 622 and second voltage supply terminal 624.

FIG. 19B is a chart showing exemplary values for a display having a common electrode maintained at 3 volts, a threshold voltage (Vtt) of 1 volt, and a saturation voltage (Vsat) of 3 volts. In this example, in the normal state, 6 volts (VC+Vsat) is asserted on the first voltage supply terminal, and 4 volts (VC+Vtt) is asserted on the second voltage supply terminal. In the inverted state 0 volts (VC−Vsat) is asserted on the first voltage supply terminal, and 2 volts (VC−Vtt) is asserted on the second voltage supply terminal.

Figure 20:
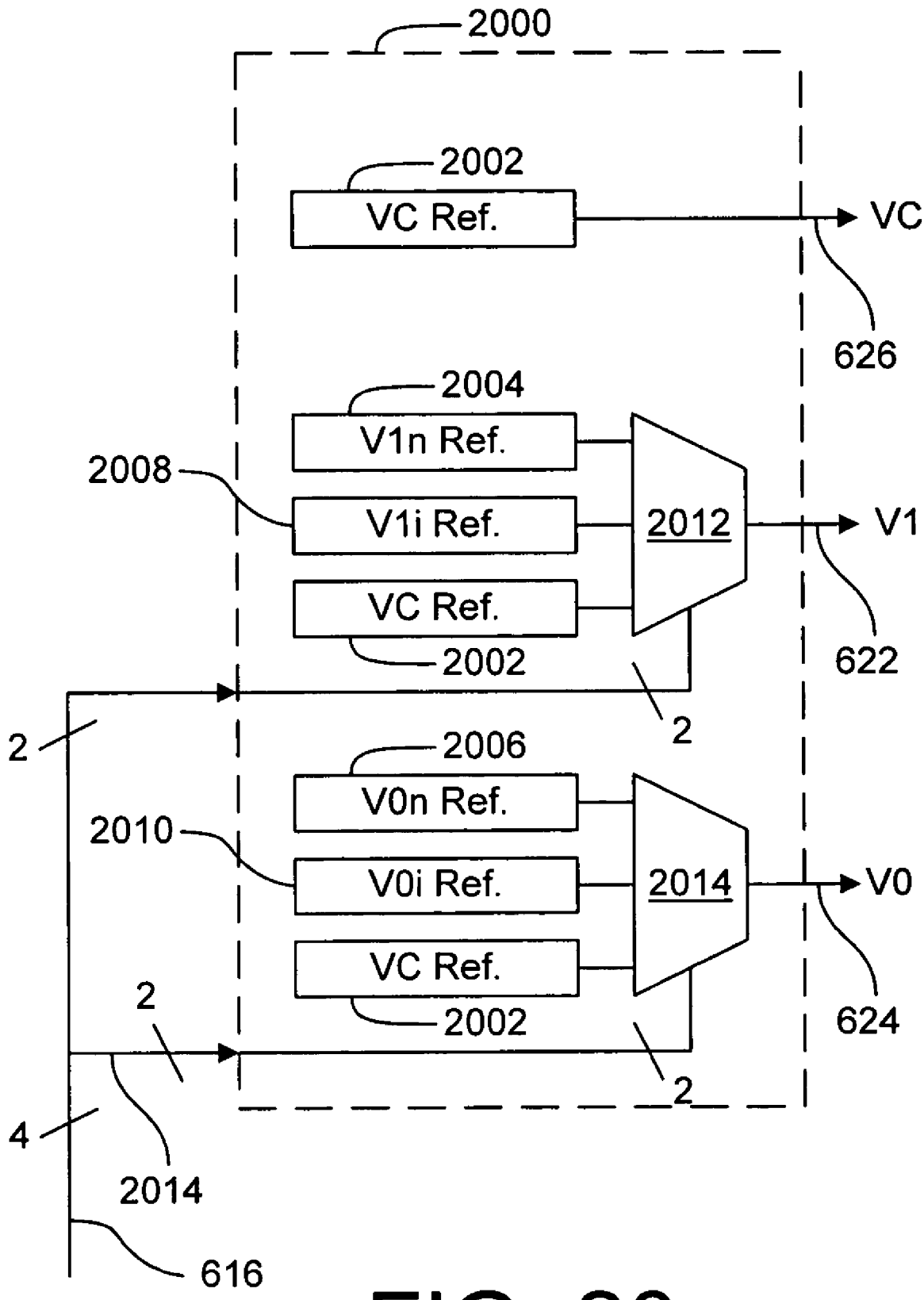
FIG. 20 is a block diagram of an alternate voltage controller for implementing a particular driving scheme in accordance with the present invention.

FIG. 20 is a block diagram of an alternate voltage controller 2000, capable of implementing the voltage scheme of FIG. 19A, in conjunction with display 600 of FIG. 6. Voltage controller 2000 includes a first voltage source 2002 for providing a first reference voltage (VC), a second voltage source 2004 for providing a second reference voltage (V1*n*), a third voltage source 2006 for providing a third reference voltage (V0*n*), a fourth voltage source 2008 for providing a fourth reference voltage (V1*i*), and a fifth voltage source 2010 for providing a fifth reference voltage (V0*i*). Although first voltage source 2002 is shown three times in FIG. 20 for the sake of clarity, it should be understood that first voltage source 2002 is actually a single voltage source. Additionally, it should be understood that any or all of voltage sources 2002, 2004, 2006, 2008, and 2010 may be either on chip voltage generators or simply supply terminals for receiving the respective reference voltages from an off chip source.

Voltage controller 2000 further includes a first multiplexer 2012 and a second multiplexer 2014. Multiplexer 2012 includes a first input terminal coupled to second voltage source 2004, a second input terminal coupled to fourth voltage source 2008, a third input terminal coupled to first voltage source 2002, an output terminal coupled to first voltage supply terminal 622, and a 2-bit control terminal set coupled to two V1 control lines 2012 of voltage control bus 616. Multiplexer 2014 includes a first input terminal coupled to third voltage source 2006, a second input terminal coupled to fifth voltage source 2010, a third input terminal coupled to first voltage source 2002, an output terminal coupled to second voltage supply terminal 624, and a 2-bit control terminal set coupled two V0 control lines 2014 of voltage control bus 616.

Voltage controller 2000 operates under the control of processing unit 606 as follows. First voltage source 2002 asserts reference voltage VC on common voltage supply terminal 626. Multiplexer 2012, responsive to control signals received via V1 control lines 2012 selectively asserts one of reference voltages V1*n*, V1*i*, or VC onto first voltage supply terminal 622, and thus onto the pixel electrodes 612 of all pixel cells 602 currently storing a logical high data bit. Multiplexer 2014, responsive to control signals received via V0 control lines 2014 selectively asserts one of reference voltages V0*n*, V0*i*, or VC onto second voltage supply terminal 624, and thus onto the pixel electrodes 612 of all pixel cells 602 currently storing a logical low data bit.

Figure 21A:
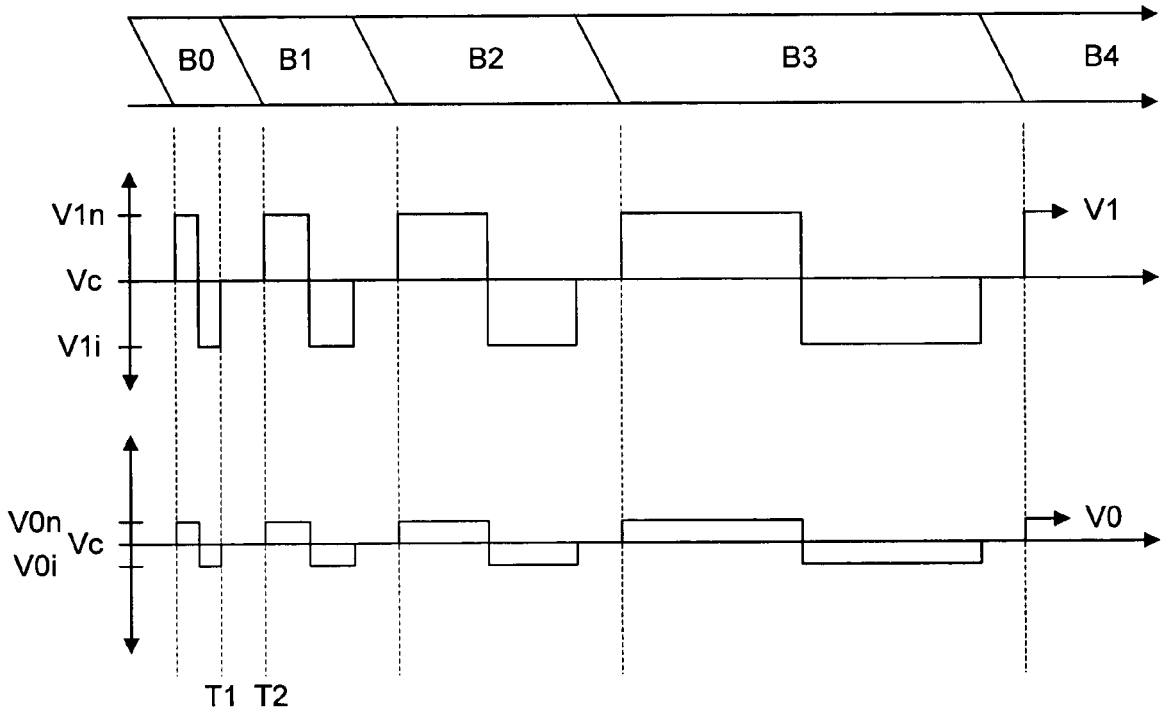
FIG. 21A is a timing diagram showing an implementation of the voltage scheme of FIG. 19A.

FIG. 21A is a timing diagram showing an implementation of the voltage scheme of FIG. 19A with voltage controller 2000. Initially, voltage controller 2000 asserts an off state on display 600 by asserting a same voltage (i.e., VC) on each of first voltage supply terminal 622, second voltage supply terminal 624, and common voltage supply terminal 626. While the off state is asserted on display 600, bit B0 is written to the latches 702 of display 600. Then, at a time T1, voltage controller 2000 asserts voltage (V1*n*) on first voltage supply terminal 622, voltage (V0*n*) on second voltage supply terminal 624, and maintains voltage (VC) on common voltage supply terminal 626. Then, after a period of time dependent on the significance of the bit (B0) stored in display 600, voltage controller 2000 switches to the debias state, with bit B0 still stored in the latches 702 of display 600, by asserting voltage (V1*i*) on first voltage supply terminal 622, voltage (V0*i*) on second voltage supply terminal 624, and maintaining voltage (VC) on common voltage supply terminal 626, for a time period equal to the previous period of time dependent on the significance of the stored bit B0. Afterwards, at a time T2, voltage controller 2000 writes an off state to display 600 so that the next bit (B1) can be written to display 600. The modulation and debiasing of display 600 for the remaining bits occurs substantially as described for bit B0, except that the time periods that voltage controller 2000 asserts the various reference voltages on the respective voltage supply terminals varies according to the significance of the particular bits written to display 600.

Figure 21B:
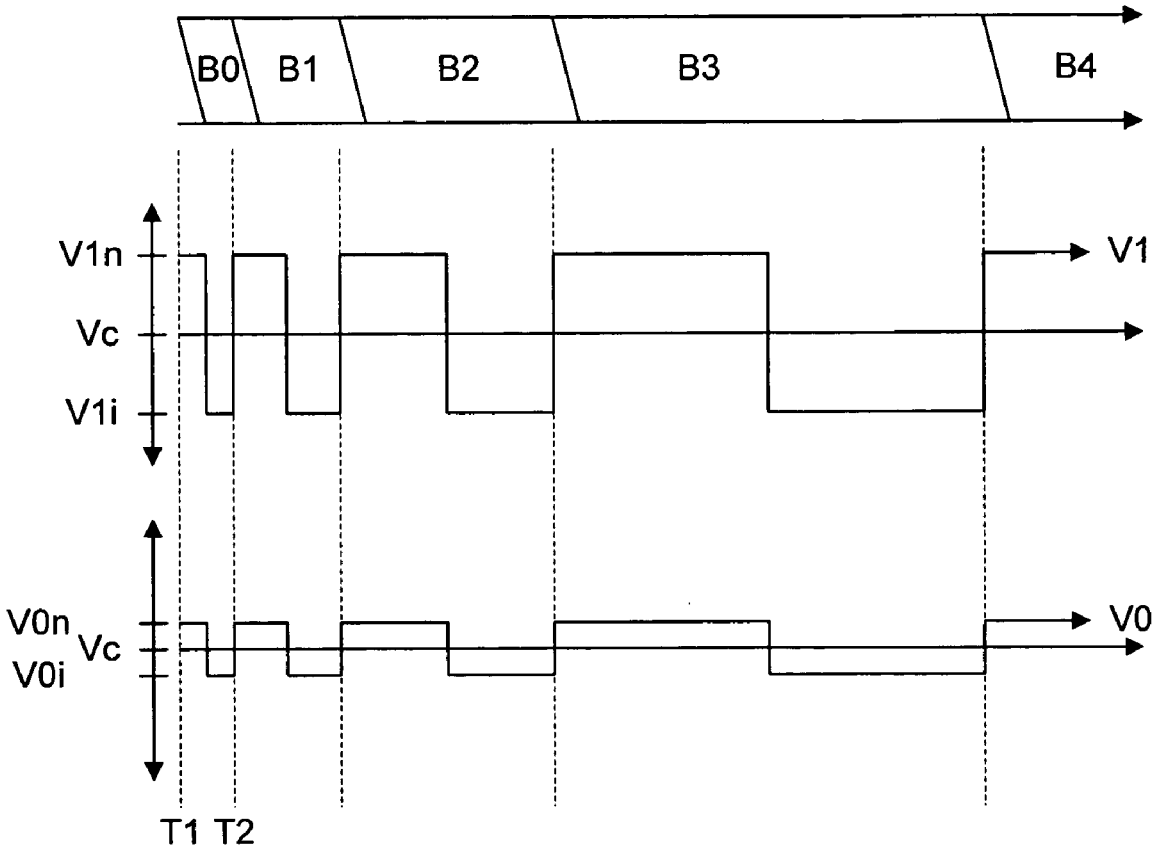
FIG. 21B is a timing diagram showing an alternate implementation of the voltage scheme of FIG. 19A.

FIG. 21B is a timing diagram similar to that shown in FIG. 21A, except that no off states are used when writing data bits to display 600. FIG. 21B is presented only to illustrate that off states are not required to properly modulate and debias a display. For example, note that starting at time T1, the writing of bit B1 to display 600 takes a finite amount of time, delaying the assertion of the respective voltages on the pixel cells at the bottom of display by bit B1. This delay is, however, compensated for by the same delay incurred in writing the next bit B2 to display 600.

Figure 22:
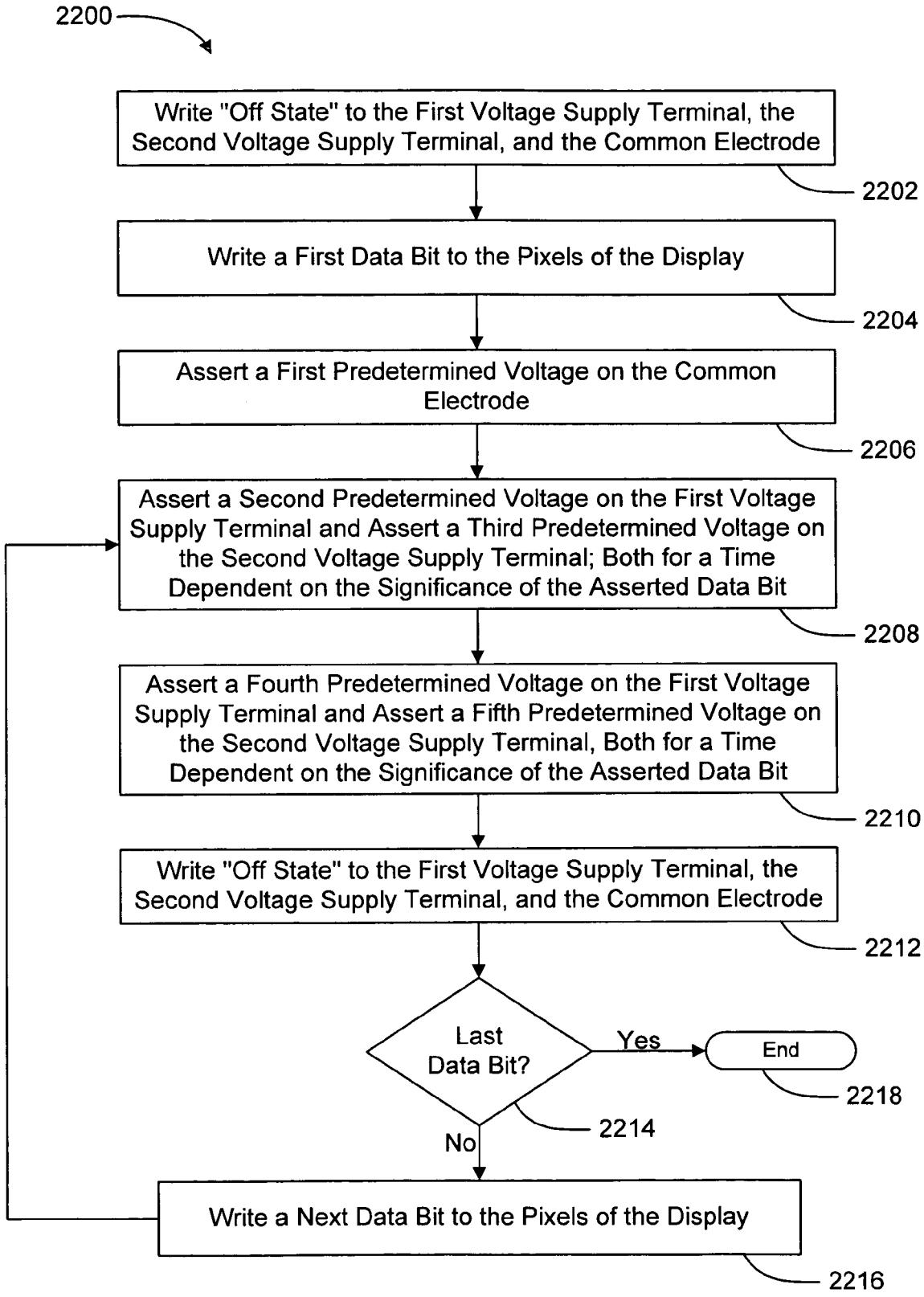
FIG. 22 is a flow chart summarizing a method for driving the display of FIG. 6, in accordance with the driving schemes of FIGS. 21A and 21B.

FIG. 22 is a flow chart summarizing an alternate method 2200 for driving a display in accordance with the voltage scheme of FIG. 19A. In a first step 2202, voltage controller 2000 writes an off state to display 600. Then, in a second step 2204, a first data bit is written to pixel cells 602 of display 600. Next, in a third step 2206, voltage controller 2000 asserts a first predetermined voltage on common electrode 610, and in a fourth step 2208 asserts a second predetermined voltage on first voltage supply terminal 622 and a third predetermined voltage on second voltage supply terminal 624, both for a time period dependent on the significance of the data bits written to the pixel cells 602 of display 600. Then, in a fifth step 2210, voltage controller 2000 asserts a fourth predetermined voltage on first voltage supply terminal 622 and a fifth predetermined voltage on second voltage supply terminal 624, both for a time period equal to the time period dependent on the significance of the data bits written to the pixel cells 602 of display 600. Next, in a sixth step 2212, voltage controller 2000 writes an off state to display 600. In a seventh step 2214, it is determined whether the last data bit has been written to display 600, and if not, then in an eighth step 2216, a next data bit is written to the pixel cells 602 of display 600, afterwhich method 2200 returns to fourth step 2208. If, in the seventh step 2214, it was determined that the last data bit had been written to display 600, then in a ninth step 2218, method 2200 ends.

Figures 23A, 23B:
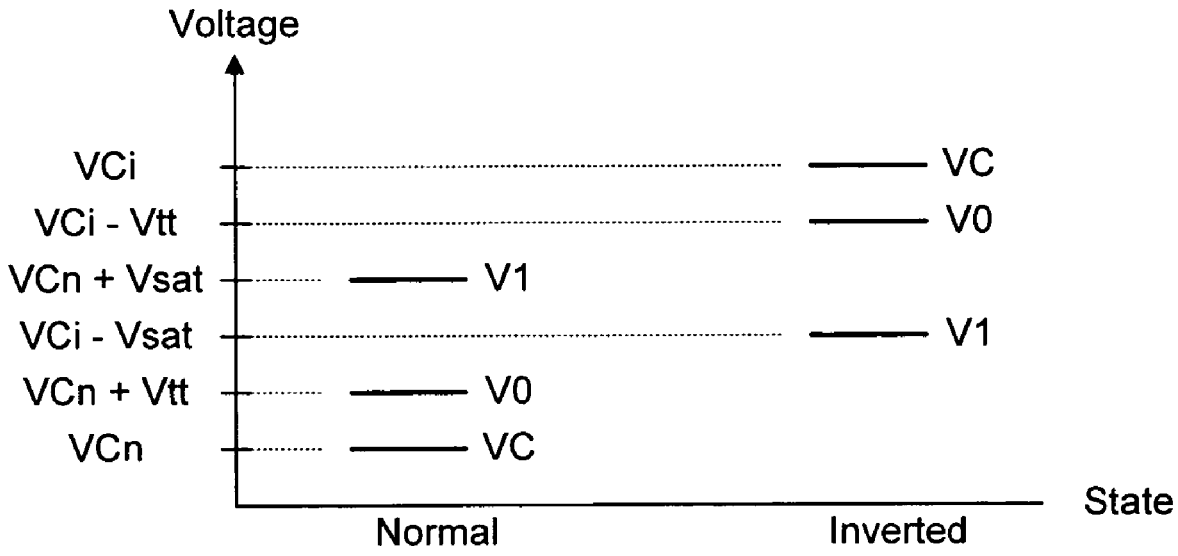
FIG. 23A is a chart showing a modulation scheme and a debias scheme for use with one embodiment of the present invention.
FIG. 23B is a chart showing sample values of the voltages shown in FIG. 23A.

FIG. 23A is a chart illustrating another alternate voltage scheme for use in accordance with the present invention. In this particular voltage scheme, during the normal state, a first predetermined reference voltage (VCn) is asserted on common voltage supply terminal (VC) 626, a second predetermined reference voltage (VCn+Vsat) is asserted on first voltage supply terminal (V1) 622, and a third predetermined reference voltage (VCn+Vtt) is asserted on second voltage supply terminal (VO) 624. During the inverted (debias) state, a fourth predetermined voltage (VCi) is asserted on common voltage supply terminal (VC) 626, a fifth predetermined voltage (VCi−Vsat) is asserted on first voltage supply terminal (V1) 622, and a sixth predetermined voltage (VCi−Vtt) is asserted on second voltage supply terminal (V0) 624. The voltage scheme of FIG. 23A beneficially provides flexibility with respect to the particular voltage values which may be employed, but requires the greatest number of voltages (i.e., 6) to drive first voltage supply terminal 622, second voltage supply terminal 624, and common voltage supply terminal 626.

FIG. 23B is a chart showing exemplary values for a display having a threshold voltage (Vtt) of 1 volt, and a saturation voltage (Vsat) of 3 volts. Additionally, VCn and VCi are arbitrarily selected to be 0 volts and 5 volts, respectively. In this example, in the normal state, 3 volts (VCn+Vsat) is asserted on the first voltage supply terminal, and 1 volt (VCn+Vtt) is asserted on the second voltage supply terminal. In the inverted state 2 volts (VCi−Vsat) is asserted on the first voltage supply terminal, and 4 volts (VCi−Vtt) is asserted on the second voltage supply terminal.

Figure 24:
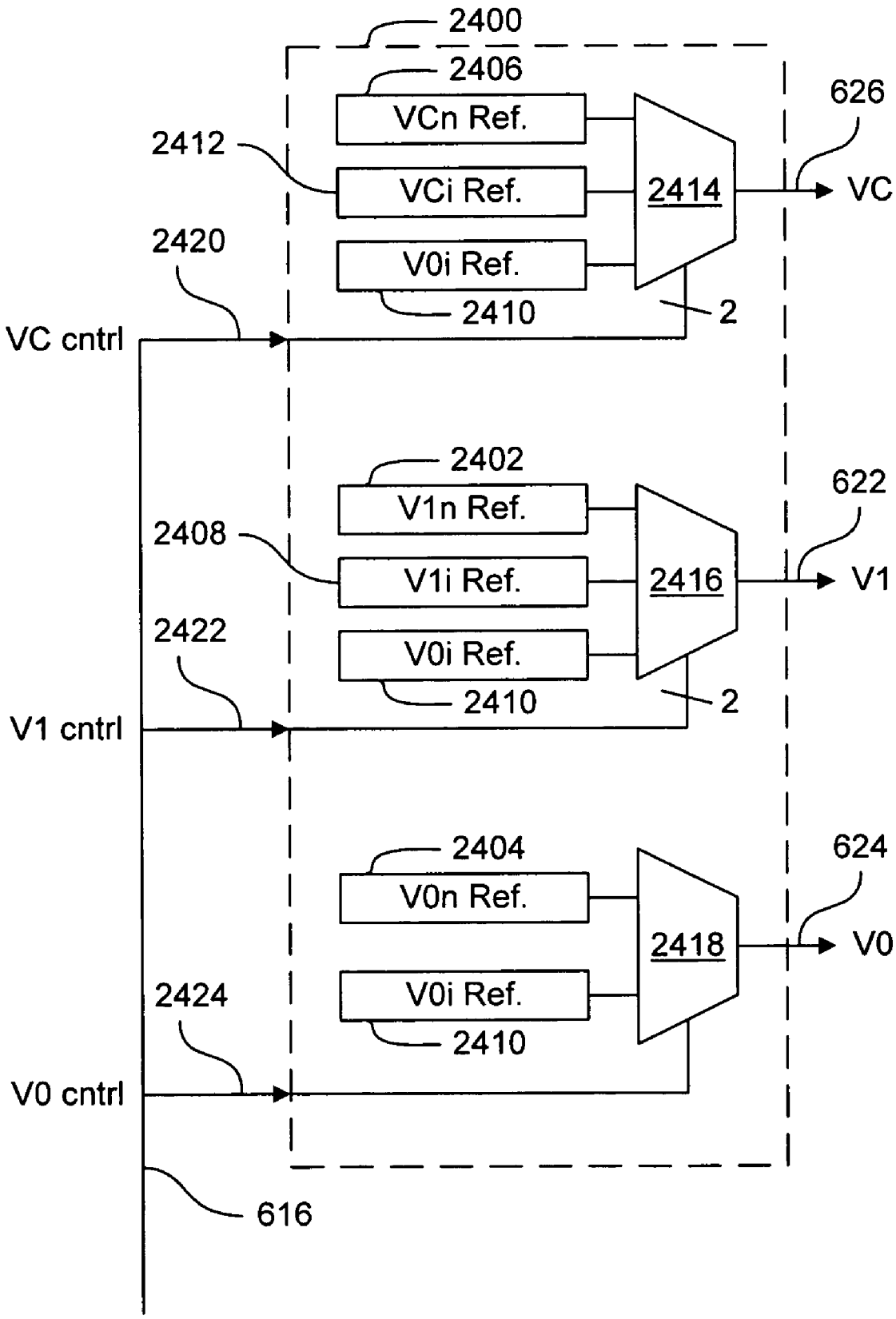
FIG. 24 is a block diagram of an alternate voltage controller for implementing a particular driving scheme in accordance with the present invention.

FIG. 24 is a block diagram of an alternate voltage controller 2400, capable of implementing the voltage scheme of FIG. 23A, in conjunction with display 600 of FIG. 6. Voltage controller 2400 includes a first voltage source 2402 for providing a first reference voltage (V1*n*), a second voltage source 2404 for providing a second reference voltage (V0*n*), a third voltage source 2406 for providing a third reference voltage (VCn), a fourth voltage source 2408 for providing a fourth reference voltage (V1*i*), a fifth voltage source 2410 for providing a fifth reference voltage (V0*i*), and a sixth voltage source 2412 for providing a sixth reference voltage (VCi). Although fifth voltage source 2410 is shown three times in FIG. 24 for the sake of clarity, it should be understood that fifth voltage source 2410 is actually a single voltage source. Additionally, it should be understood that any or all of voltage sources 2402, 2404, 2406, 2408, 2410, and 2412 may be either on chip voltage generators or simply supply terminals for receiving the respective reference voltages from an off chip source.

Voltage controller 2400 further includes a first multiplexer 2414, a second multiplexer 2416, and a third multiplexer 2018. Multiplexer 2414 includes a first input terminal coupled to third voltage source 2406, a second input terminal coupled to sixth voltage source 2412, a third input terminal coupled to fifth voltage source 2410, an output terminal coupled to common voltage supply terminal 626, and a 2-bit control terminal set coupled to two VC control lines 2420 of voltage control bus 616. Multiplexer 2416 includes a first input terminal coupled to first voltage source 2402, a second input terminal coupled to fourth voltage source 2408, a third input terminal coupled to fifth voltage source 2410, an output terminal coupled to first voltage supply terminal 622, and a 2-bit control terminal set coupled two V1 control lines 2422 of voltage control bus 616. Third multiplexer 2418 includes a first input terminal coupled to second voltage source 2404, a second input terminal coupled to fifth voltage source 2410, an output terminal coupled to second voltage supply terminal 624, and a single control terminal coupled to a V0 control line 2424 of voltage control bus 616.

Voltage controller 2400 operates under the control of processing unit 606 as follows. Multiplexer 2414, responsive to control signals received via VC control lines 2420, selectively asserts on of reference voltages VCn, VCi, of V0*i* onto common voltage supply terminal 626, and thus also on common electrode 610. Multiplexer 2416, responsive to control signals received via V1 control lines 2422 selectively asserts one of reference voltages V1*n*, V1*i*, or V0*i* onto first voltage supply terminal 622, and thus onto the pixel electrodes 612 of all pixel cells 602 currently storing a logical high data bit. Multiplexer 2418, responsive to control signals received via V0 control line 2424 selectively asserts one of reference voltages V0*n* or V0*i* onto second voltage supply terminal 624, and thus onto the pixel electrodes 612 of all pixel cells 602 currently storing a logical low data bit.

Figure 25:
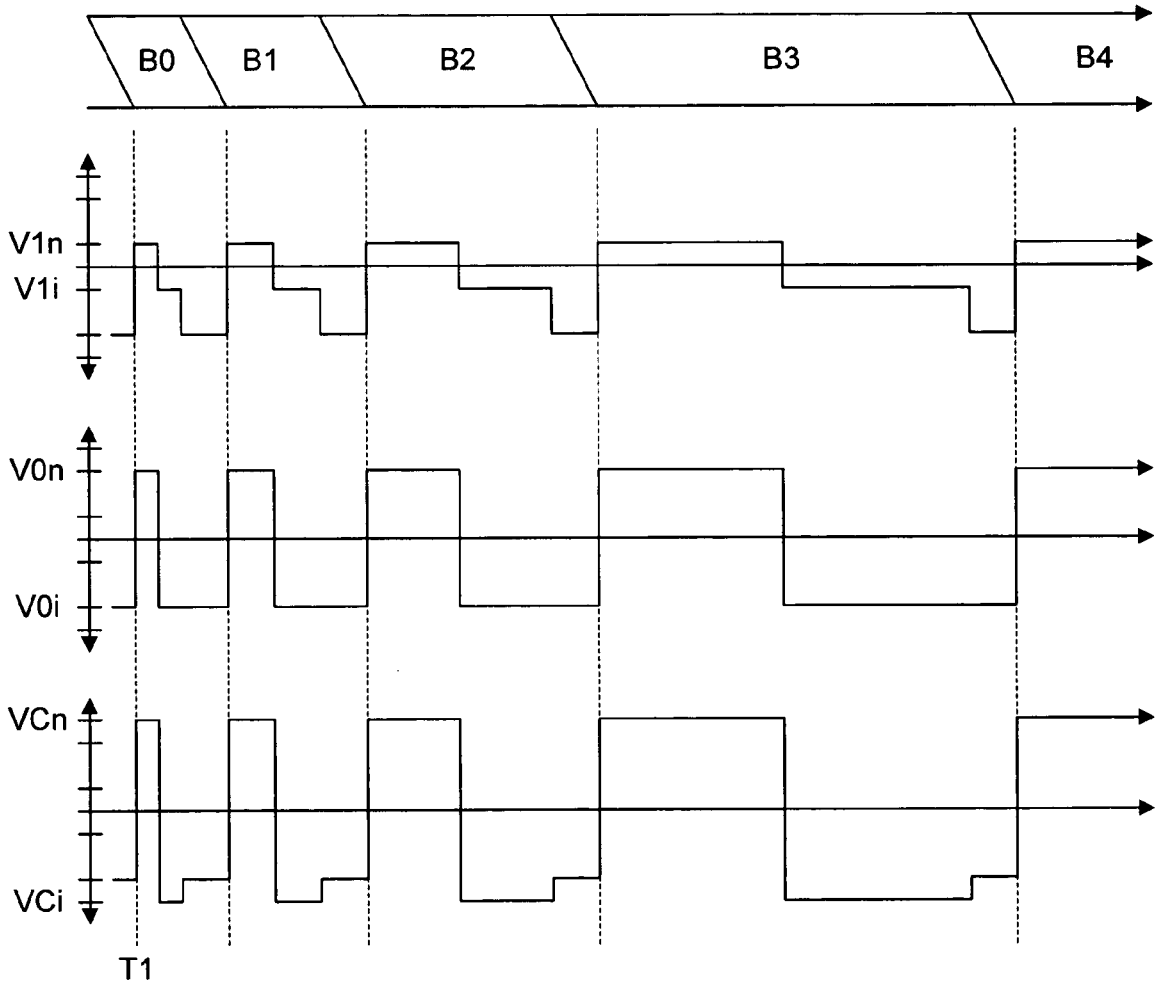
FIG. 25 is a timing diagram showing an implementation of the voltage scheme of FIG. 23A.

FIG. 25 is a timing diagram showing an implementation of the voltage scheme of FIG. 23A with voltage controller 2400. Initially, voltage controller 2400 asserts an off state on display 600 by asserting a same voltage (i.e., V0*i*) on each of first voltage supply terminal 622, second voltage supply terminal 624, and common voltage supply terminal 626. While the off state is asserted on display 600, bit B0 is written to the latches 702 of display 600. Then, at a time T1, voltage controller 2400 asserts voltage (V1*n*) on first voltage supply terminal 622, voltage (V0*n*) on second voltage supply terminal 624, and voltage (VCn) on common voltage supply terminal 626. Then, after a period of time dependent on the significance of the bit (B0) stored in display 600, voltage controller 2400 switches to the debias state, with bit B0 still stored in the latches 702 of display 600, by asserting voltage (V1*i*) on first voltage supply terminal 622, voltage (V0*i*) on second voltage supply terminal 624, and voltage (VCi) on common voltage supply terminal 626, for a time period equal to the previous period of time dependent on the significance of the stored bit B0. Immediately thereafter, voltage controller 2400 reasserts an off state on display 600, by asserting voltage (V0*i*) on each of voltage supply terminals 622, 624, and 626, so that the next bit (B1) can be written to display 600. The modulation and debiasing of display 600 for the remaining bits occurs substantially as described for bit B0, except that the time periods that voltage controller 2400 asserts the various reference voltages on the respective voltage supply terminals varies according to the significance of the particular bits written to display 600.

Figure 26:
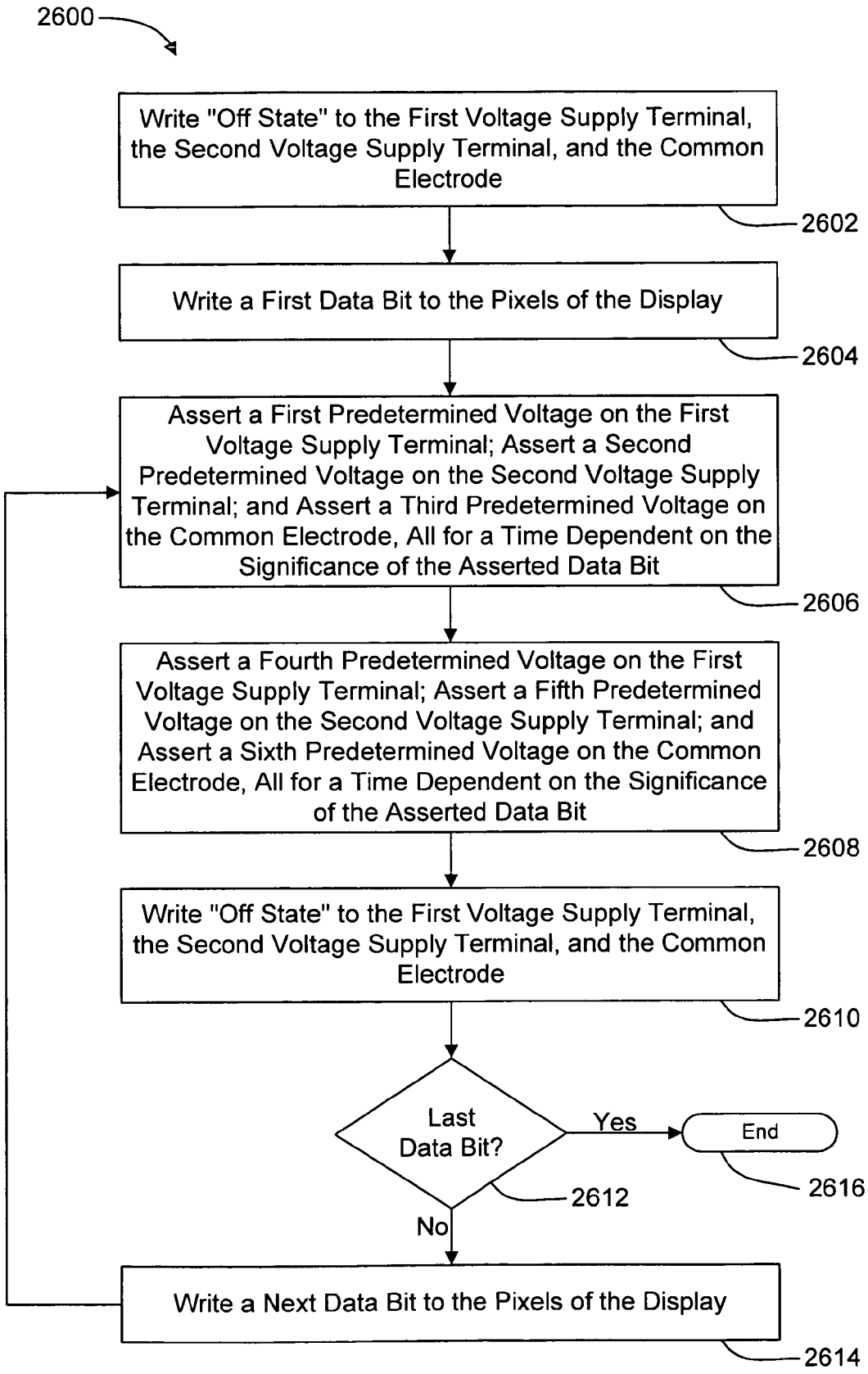
FIG. 26 is a flow chart summarizing a method for driving the display of FIG. 6 in accordance with the driving scheme of FIG. 25.

FIG. 26 is a flow chart summarizing an alternate method 2600 for driving display 600 in accordance with the voltage scheme of FIG. 23A. In a first step 2602, voltage controller 2400 asserts an off state on display 600. Then, in a second step 2604, a first data bit is written to the pixel cells 602 of display 600. Next, in a third step 2606, voltage controller 2400 asserts a first predetermined voltage on first voltage supply terminal 622, a second predetermined voltage on second voltage supply terminal 624, and a third predetermined voltage on common voltage supply terminal 626, all for a time period dependent on the significance of the bit stored in display 600. Thereafter, in a fourth step 2608, voltage controller 2400 asserts a fourth predetermined voltage on first voltage supply terminal 622, a fifth predetermined voltage on second voltage supply terminal 624, and a sixth predetermined voltage on common voltage supply terminal 626, all for a time period equal to the previous time period dependent on the significance of the data bit stored in display 600. Next, in a fifth step 2610, voltage controller asserts an off state on display 600. In a sixth step 2612, it is determined whether the last data bit has been written to display 600. If not, then in a seventh step 2614, a next data bit is written to pixel cells 602 of display 600, and method 2600 returns to the third step 2606. If, in the sixth step 2612 it was determined that the last data bit had been written to display 600, then in an eighth step 2616, method 2600 ends.

The various voltage controllers described above have generally relied on modulating display 600 by asserting a limited number of voltages on first voltage supply terminal 622, second voltage supply terminal 624, and common voltage supply terminal 626 for periods of time dependent on the significance of the bits stored in display 600. Because the response of pixel cells 602 depends on the RMS voltages across the cells, other modulation schemes are possible. For example, in one scheme, a pixel can be modulated by varying the amplitude of a voltage pulse, while holding the time duration constant. Alternatively, the duration of the pulse can be varied, while holding the voltage amplitude constant. In yet another scheme, both the amplitude and the duration of the pulse can be varied.

Figure 27:
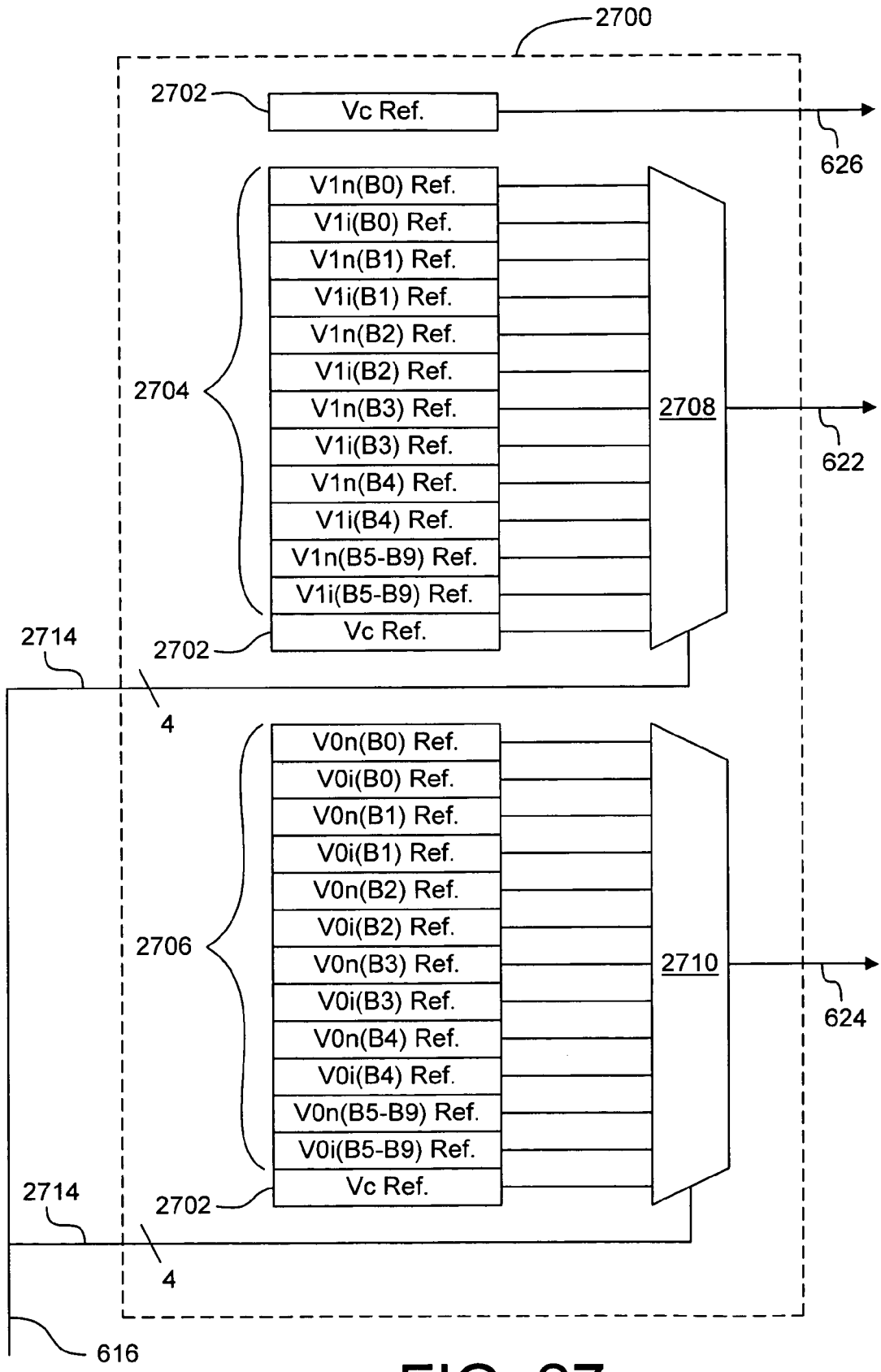
FIG. 27 is a block diagram of an alternate voltage controller for implementing a particular driving scheme in accordance with the present invention.

FIG. 27 is a block diagram of an alternate voltage controller 2700 for implementing a modulation/debiasing scheme based on voltage amplitudes. Voltage controller 2700 includes a first voltage source 2702 for providing a first reference voltage (VC), a first plurality 2704 of voltage sources for providing a variety of reference voltages for selective assertion on first voltage supply terminal (V1) 622, and a second plurality of voltage sources for providing a variety of reference voltages for selective assertion on second voltage supply terminal (V0) 624. Each of the voltage sources of the first plurality 2704 of voltage sources provides a voltage whose amplitude depends on the significance of an associated one of data bits (B0-B9) and the saturation voltage (Vsat) of display 600. Similarly, each of the voltage sources of the second plurality of voltage sources provides a voltage whose amplitude depends on the significance of an associated one of data bits (B0-B9) and the threshold voltage (Vtt) of display 600.

Additionally, each of the voltage sources in the first plurality 2704 and the second plurality 2706 of voltage sources is associated with another of the voltage sources to implement debiasing of the pixel cells. For example, voltage V1*n*(B2) is equal in magnitude but opposite in polarity (with respect to voltage VC) than voltage V1*i*(B2).

Note that in this particular embodiment, bits (B5-B9) are of coequal significance (i.e., equally weighted). Such a data scheme is described in detail in copending U.S. patent application Ser. No. 09/032,174, filed on Feb. 27, 1998, by Worley et al, which is incorporated herein by reference in its entirety.

Voltage controller 2700 further includes a first multiplexer 2708 and a second multiplexer 2710. First multiplexer 2708 includes a plurality of input terminals, each coupled one of voltage sources of the first plurality 2704 of voltage sources, an additional input terminal coupled to first voltage source 2702, an output terminal coupled to first voltage supply terminal 622, and a 4-bit control terminal set coupled to V1 control lines 2712 of voltage control bus 616. Responsive to control signals received from processing unit 606, via V1 control lines 2712, multiplexer 2708 selectively asserts one of the reference voltages coupled to its input terminals onto first voltage supply terminal 622. Second multiplexer 2710 includes a plurality of input terminals, each coupled to one of voltage sources of the first plurality 2706 of voltage sources, an additional input terminal coupled to first voltage source 2702, an output terminal coupled to second voltage supply terminal 624, and a 4-bit control terminal set coupled to V0 control lines 2714 of voltage control bus 616. Responsive to control signals received from processing unit 606, via V0 control lines 2714, multiplexer 2710 selectively asserts one of the reference voltages coupled to its input terminals onto second voltage supply terminal 624.

Although first voltage source 2702 is shown three times in FIG. 27 for the sake of clarity, it should be understood that first voltage source 2702 is actually a single device. Additionally, any or all of the voltage sources shown in FIG. 27 may be on-chip voltage generators or, alternatively, simply supply terminals for receiving the various voltages from an off chip source.

Figure 28:
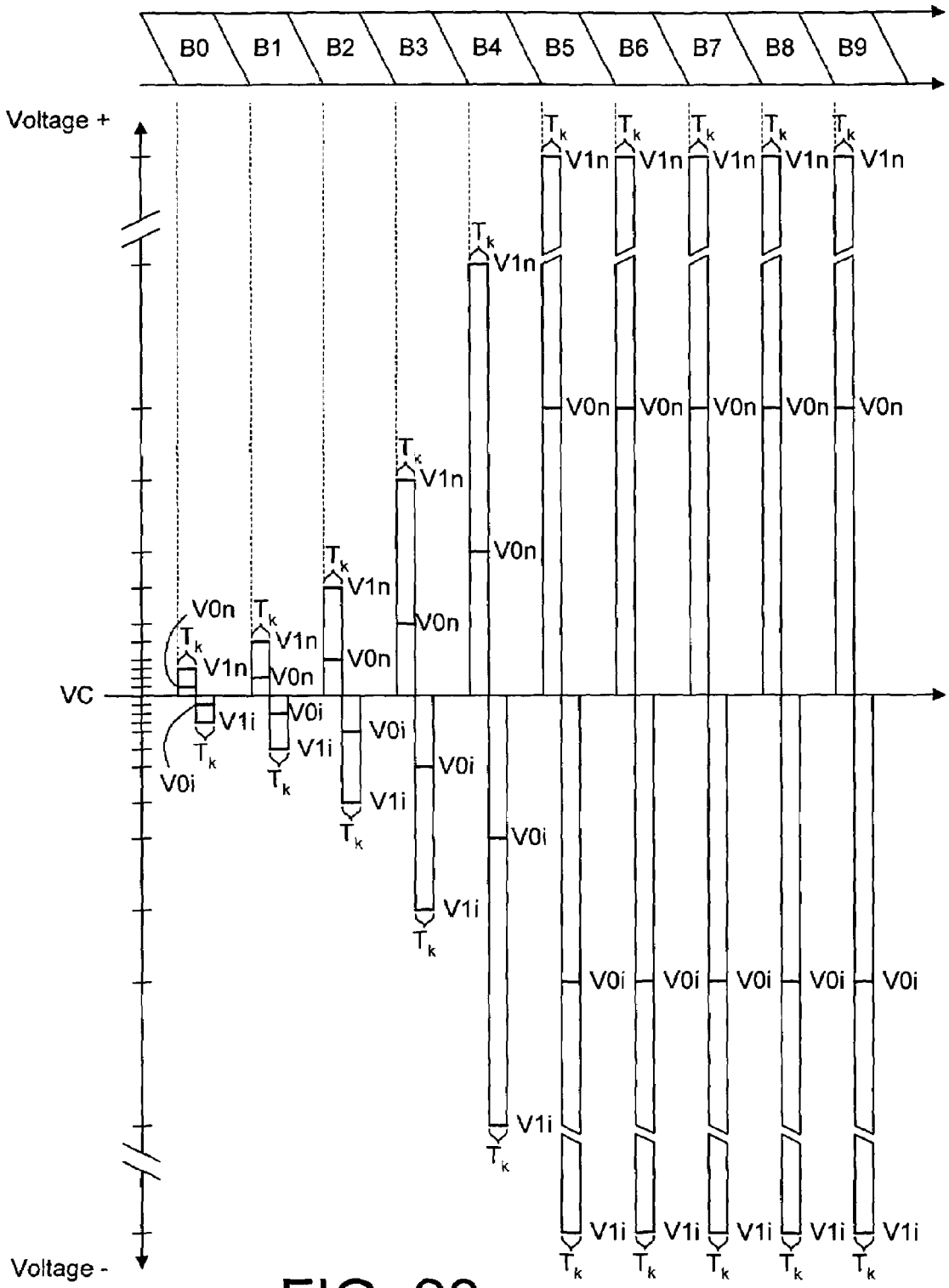
FIG. 28 is a timing diagram showing an alternate driving scheme for use with the display of FIG. 6.

FIG. 28 is a timing diagram showing a particular scheme for modulating and debiasing display 600 (FIG. 6) with voltage controller 2700 of FIG. 27. Initially, voltage controller 2700 asserts an off state on display 600, while bit B0 is written to pixel cells 602. Then, at a time T1, voltage controller 2700 asserts reference voltage V1*n*(B0) on first voltage supply terminal 622, reference voltage V0*n*(B0) on second voltage supply terminal 624, and reference voltage VC on common voltage supply terminal 626, all for a time period having a predetermined duration Tk. Immediately thereafter, voltage controller 2700 asserts reference voltage V1*i*(B0) on first voltage supply terminal 622, reference voltage V0*i*(B0) on second voltage supply terminal 624, and reference voltage VC on common voltage supply terminal 626, all for time Tk. Next, voltage controller 2700 asserts another off state on display 600, during which bit B1 is written to pixel cells 602 of display 600. Then, at time T2, with bit B1 stored in latches 702 of display 600, voltage controller 2700 asserts voltage V1*n*(B1) on first voltage supply terminal 622, voltage V0*n*(B1) on second voltage supply terminal 624, and voltage VC on common voltage supply terminal 624, all for time Tk. Immediately thereafter, in order to debias the pixel cells, voltage controller 2700 asserts voltage V1*i*(B1) on first voltage supply terminal 622, voltage V0*i*(B1) on second voltage supply terminal 624, and voltage VC on common voltage supply terminal 624.

Subsequent bits (B2-B4) are written to display 600, and their associated voltages are asserted on first voltage supply terminal 622 and second voltage supply terminal 624 for time Tk. The voltage pulses for bits B5-B9 are shown broken, because the page is not large enough to show the amplitude of voltages V1*n*(B5-B9) and V1*i*(B5-B9) in proper scale. In every case, however, the time width of the respective pulse is the same (Tk), and the amplitude of the reference voltages are selected to generate an RMS voltage appropriate for the significance of the associated bit.

Figure 29:
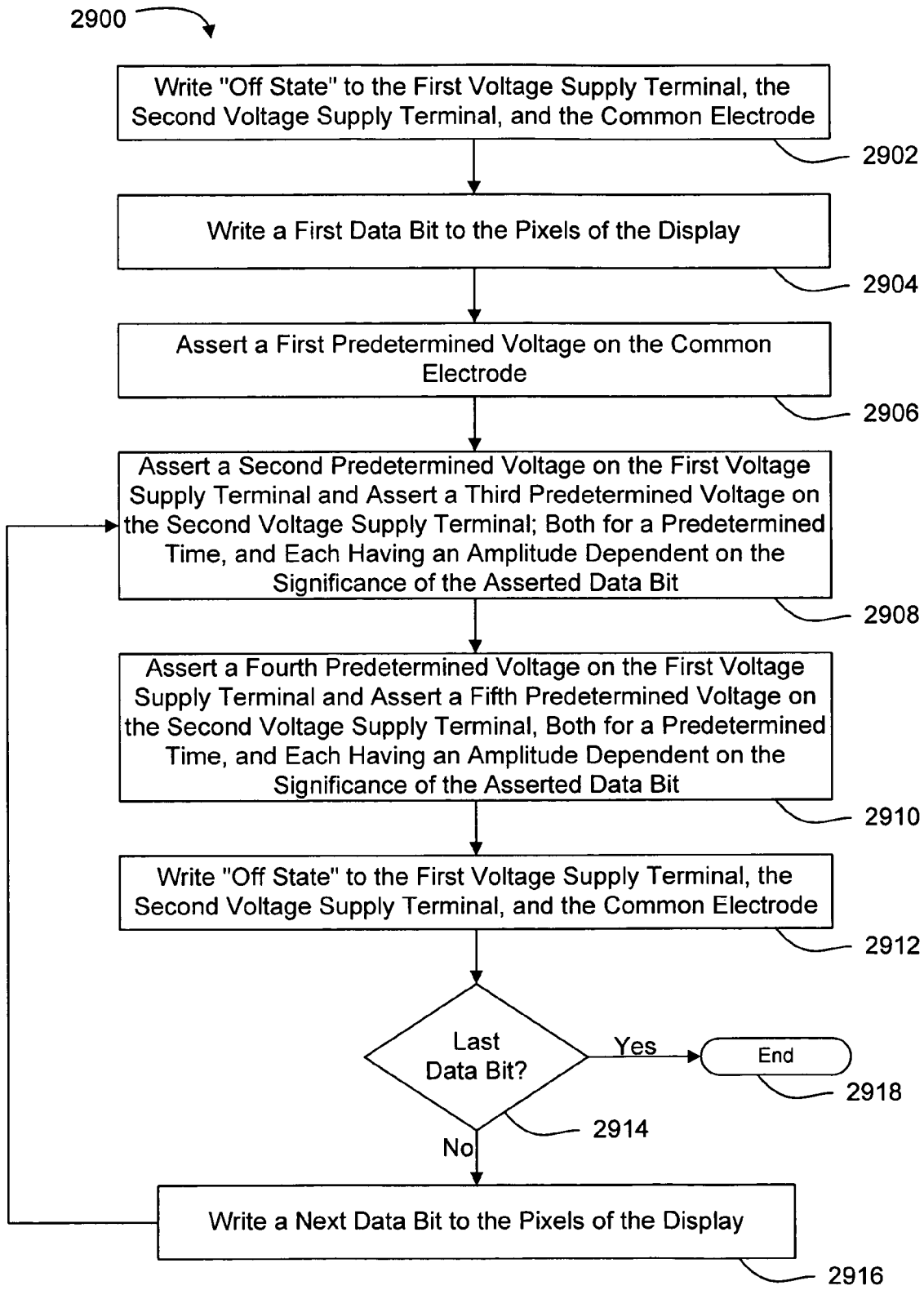
FIG. 29 is a flow chart summarizing a method for driving the display of FIG. 6 in accordance with the driving scheme of FIG. 28.

FIG. 29 is a flow chart summarizing a method 2900 for writing a multi-bit data word to display 600 in accordance with an amplitude based voltage scheme such as that described with reference to FIG. 28. In a first step 2902, voltage controller 2700 writes an off state to display 600. Then, in a second step 2904, a first data bit (e.g., B0) is written to the pixels of display 600. Next, in a third step 2906, voltage controller 2700 asserts a first predetermined voltage (VC), via common voltage supply terminal 626, onto common electrode 610. Then, in a fourth step 2908, voltage controller 2700 asserts a second predetermined voltage (e.g., V1*n*(B0)) on first voltage supply terminal 622, and a third predetermined voltage (e.g., V0*n*(B0)) on second voltage supply terminal 624, both for a first predetermined time period, and each having an amplitude dependent on the significance of the bit in display 600. Next, in a fifth step 2910, voltage controller 2700 asserts a fourth predetermined voltage (e.g., V1*i*(B0) on first voltage supply terminal 622, and a fifth predetermined voltage (e.g., V0*i*(B0)) on second voltage supply terminal 624, both for a second predetermined time period, and each having an amplitude dependent on the significance of the data bit in display 600. In a particular method, the first predetermined time period is equal to the second predetermined time period, the second predetermined voltage is equal in amplitude but opposite in polarity to the fourth predetermined voltage, and the third predetermined voltage is equal in magnitude but opposite in polarity to the fifth predetermined voltage. In any event, the assertion of the various predetermined voltages for their respective time periods combine to result in a net DC bias of 0 volts across the pixel cells 602 of display 600. Next, in a sixth step 2912, voltage controller 2700 asserts an off state on display 600. In a seventh step 2914, it is determined whether the last data bit has been written to display 600. If not, then in an eighth step 2916, a next data bit (e.g., B1) is written to the storage elements 702 of display 600, and method 2900 returns to fourth step 2908. If, however, in the seventh step 2914, it is determined that the last data bit (e.g., B9) has been written to the latches 702 of display 600, then in a ninth step 2918, method 2900 ends.

Figure 30:
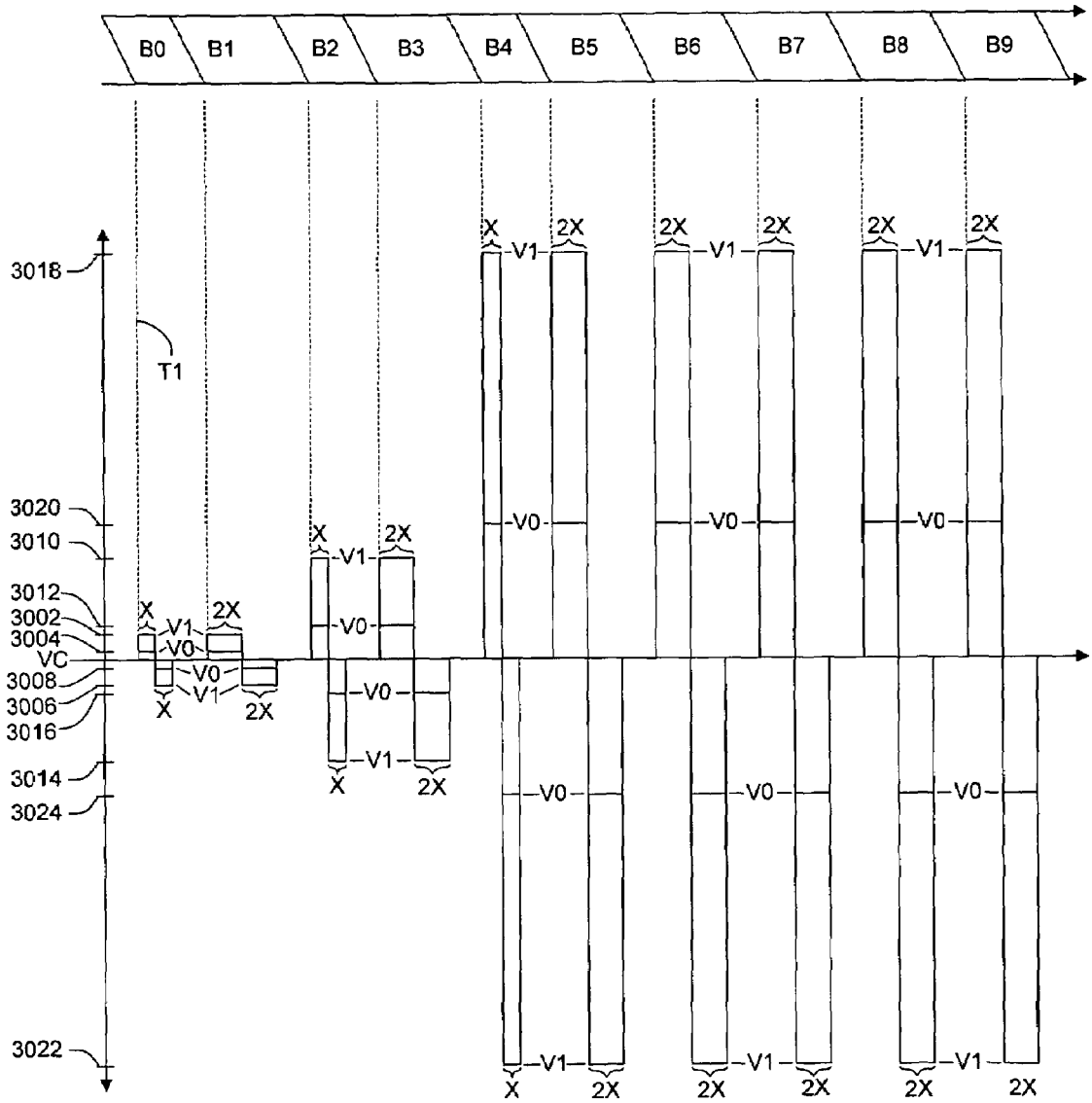
FIG. 30 is a timing diagram showing an alternate driving scheme for use with the display of FIG. 6.

FIG. 30 is a timing diagram that shows a scheme for writing multi-bit data words to display 600, which utilizes both time and amplitude modulation to generate desired RMS voltages. In other words, the time period that a particular voltage is asserted on a voltage supply line depends on both the amplitude of the asserted voltage and the significance of the bit stored in the latches 702 of display 600. Such a driving scheme can be carried out with a voltage controller having fewer voltage sources than voltage controller 2700. To illustrate, the timing diagram of FIG. 30 will be described with reference to voltage controller 2700, but noting that not all voltage sources of voltage controller 2700 are utilized.

Initially, voltage controller 2700 asserts an off state (voltage VC on first voltage supply terminal 622, second voltage supply terminal 624, and common voltage supply terminal 626) on display 600, during which time bit B0 is written to storage elements 702 of display 600. Then, at time T1, voltage controller 2700 asserts voltage V1*n*(B0) 3002 on first voltage supply terminal (V1) 622, and asserts voltage V0*n*(B0) 3004 on second voltage supply terminal (V0) 624, both for a period of time (x). Immediately thereafter, voltage controller 2700 asserts voltage V1*i*(B0) 3006 on first voltage supply terminal (V1) 622, and asserts voltage V0*i*(B0) 3008 on second voltage supply terminal (V0) 624, both for an equal period of time (x). Immediately thereafter, voltage controller 2700 asserts a second of state on display 600, during which the next bit B1 is written to storage elements 702 of display 600.

Next, rather than asserting voltage V1*n*(B1) and V0*n*(B1) on first voltage supply terminal 622 and second voltage supply terminal 624, respectively, voltage controller 2700 reasserts voltage V1*n*(B0) 3002 on first voltage supply terminal (V1) 622, and reasserts voltage V0*n*(B0) 3004 on second voltage supply terminal (V0) 624. However, because voltage V1*n*(B0) 3002 and voltage V0*n*(B0) 3004 are only half the magnitude of voltages V1*n*(B1) and V0*n*(B1), respectively, they must be asserted for a time period that corresponds to twice the RMS voltage (i.e., 2×). Voltage controller 2700 then asserts voltage V1*i*(B0) 3006 on first voltage supply terminal (V1) 622, and asserts voltage V0*i* (B0) 3008 on second voltage supply terminal (V0) 624, both for a time period of (2×). Thus, voltage sources V1*n*(B1) Ref., V1*i*(B1) Ref, V0*n*(B1) Ref, and V0*i*(B1) Ref. may be optionally eliminated from voltage controller 2700.

As another example of reducing the number of voltage sources required in voltage controller 2700, note that in FIG. 30, the modulation and debias for bit B3 is accomplished using reference voltages V1*n*(B2) 3010, V0*n*(B2) 3012, V1*i*(B2) 3014, and V0*i*(B2) 3016, thus eliminating the need for reference voltages V1*n*(B3), V0*n*(B3), V1*i*(B3), and V0*i*(B3). Similarly, the modulation and debias for bits B5-B9 is accomplished using reference voltages V1*n*(B4) 3018, V0*n*(B4) 3020, V1*i*(B4) 3022, and V0*i*(B4) 3024, thus eliminating the need for reference voltages V1*n*(B5-B9), V0*n*(B5-B9), V1*i*(B5-B9), and V0*i*(B5-B9).

The optimum number of reference voltages included in a voltage controller must be determined on an application by application basis. For example, by using separate voltages for each bit, modulation time can be decreased. In other instances, it may be desirable to adjust modulation voltages downward to increase the time available to write data to the display. On the other hand, the provision of a large number of different voltages on a chip can be problematic from a manufacturing standpoint.

Figure 31:
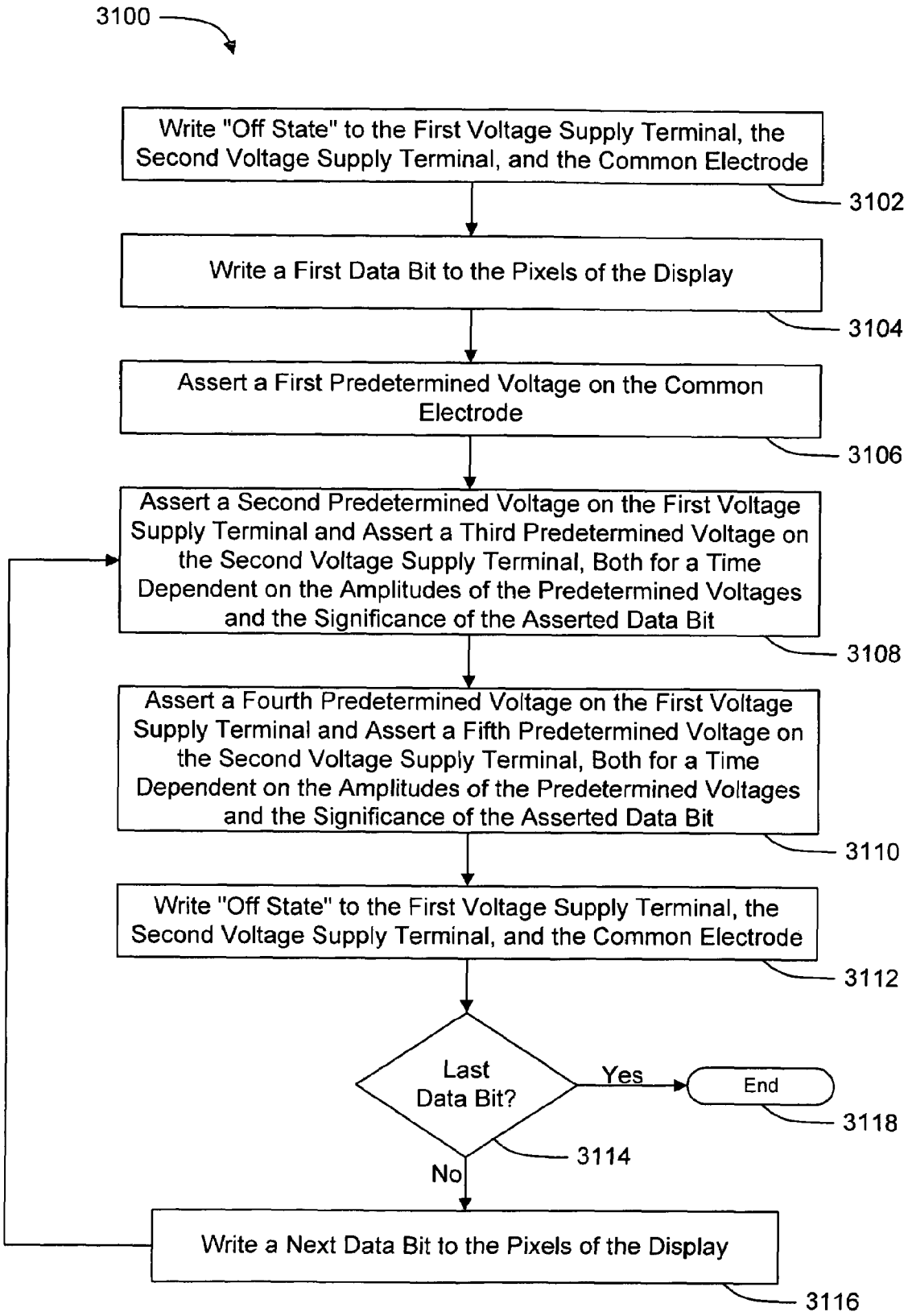
FIG. 31 is a flow chart summarizing a method for driving the display of FIG. 6 in accordance with the driving scheme of FIG. 30.

FIG. 31 is a flow chart summarizing a method 3100 for writing multi-bit data words to display 600, wherein both the amplitudes and duration of asserted voltages may vary according to the significance of particular data bits. In a first step 3102 voltage controller 2700 asserts an off state on display 600. Then, in a second step 3104, a first data bit is written to the latches 702 of display 600. In a third step 3106, voltage controller 2700 asserts a first predetermined voltage on common electrode 610 of display 600. Then, in a fourth step 3108, voltage controller 2700 asserts a second predetermined voltage on first voltage supply terminal 622, and asserts a third predetermined voltage on second voltage supply terminal 624, both for a time dependent on the amplitudes of the second and third predetermined voltages and the significance of the data bit in display 600. Next, in a fifth step voltage controller 2700 asserts a fourth predetermined voltage on first voltage supply terminal 622, and asserts a fifth predetermined voltage on second voltage supply terminal 624, both for a time dependent on the amplitudes of the fourth and fifth predetermined voltages and the significance of the data bit in display 600. Then, in a sixth step 3112, voltage controller 2700 writes an off state to display 600. In a seventh step 3114 it is determined whether the last bit of the multi-bit data word has been written to display 600. If not, then in an eighth step 3116, a next data bit is written to display 600, afterwhich method 3100 returns to fourth step 3108. If, in seventh step 3114 it was determined that the last bit of the multi-bit data word had been written to display 600, then in a ninth step 3118, method 3100 ends.

Figure 32:
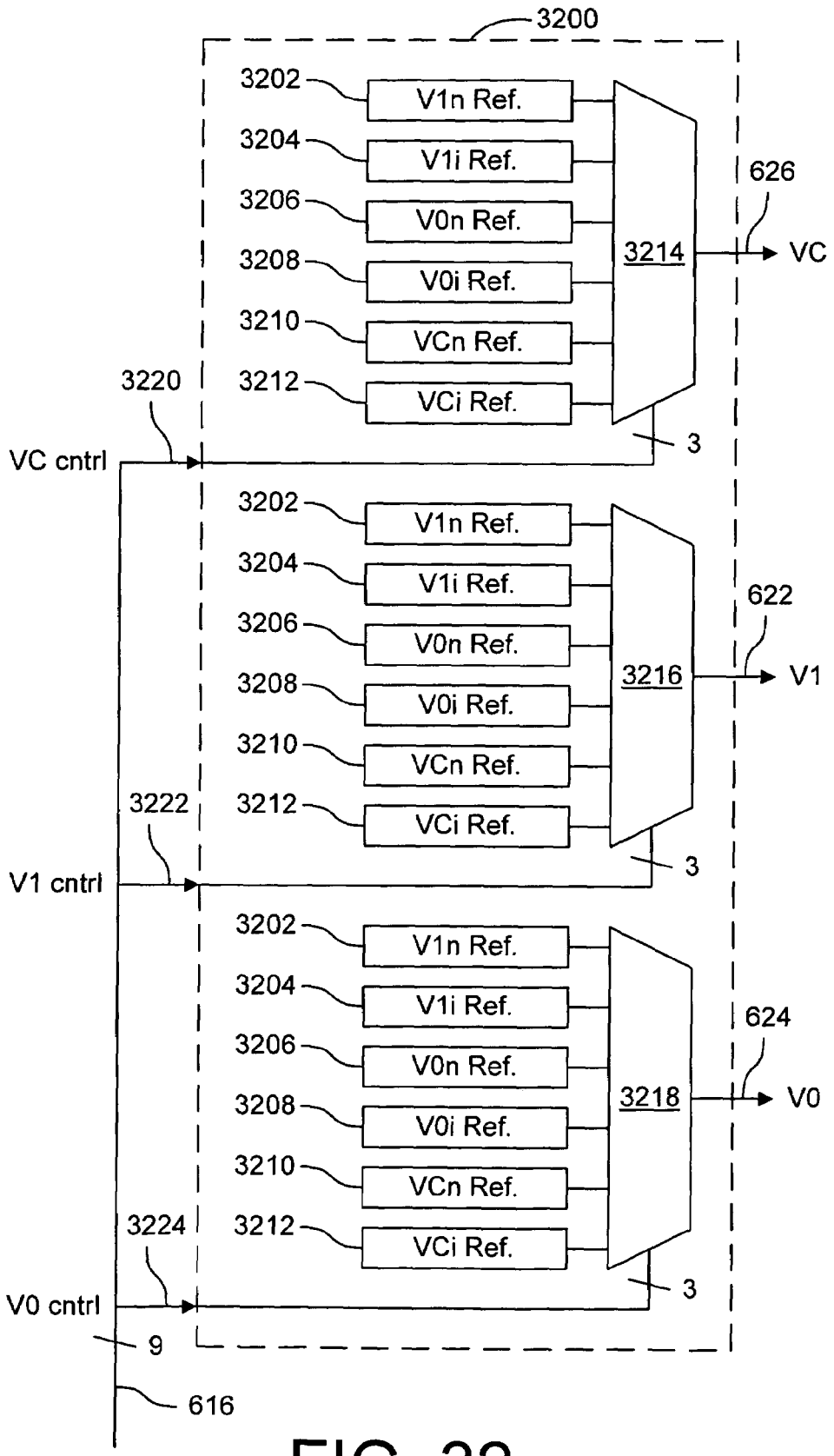
FIG. 32 is a block diagram of an alternate voltage controller for implementing a particular driving scheme in accordance with the present invention.

FIG. 32 is a block diagram of a voltage controller 3200 capable of writing a number of different off states to display 600. Previously described voltage controllers are somewhat limited in their ability to write off states to display 600, each being limited to a single off state. For example, voltage controller 800 (FIG. 8) can not write an off state to display 600 because it can not simultaneously assert a same voltage on each of first voltage supply terminal 622, second voltage supply terminal 624, and common voltage supply terminal 626. Voltage controller 1300 (FIG. 13) is able to write a single off state to display 600 by simultaneously asserting voltage VCn on each of first voltage supply terminal 622, second voltage supply terminal 624 and common voltage supply terminal 626. Similarly, voltage controller 1600 (FIG. 16) is able to write a single off state to display 600 by simultaneously asserting voltage V1*n* on each of first voltage supply terminal 622, second voltage supply terminal 624 and common voltage supply terminal 626. Voltage controllers 2000 (FIG. 20) and 2700 (FIG. 27) are also limited to generating a single off state, having the ability to simultaneously assert voltage VC on each of first voltage supply terminal 622, second voltage supply terminal 624 and common voltage supply terminal 626. Finally, voltage controller 2400 (FIG. 24) is limited to generating a single off state by simultaneously assert voltage VC on each of first voltage supply terminal 622, second voltage supply terminal 624 and common voltage supply terminal 626. As the foregoing examples indicate, virtually any voltage may be used to assert an off state on a display as long as a same voltage can be simultaneously asserted on each of the voltage supply terminals so that there is no voltage across the liquid crystal cells.

In contrast to the above described voltage controllers, voltage controller 3200 is capable of writing a number of different off states to display 600, advantageously reducing the magnitude of the voltage swings on the voltage supply lines required to drive display 600. Voltage controller 3200 includes a first voltage source 3202 for providing reference voltage V1*n*, a second voltage source 3204 for providing reference voltage V1*i*, a third voltage source 1306 for providing reference voltage V0*n*, a fourth voltage source 3208 for providing reference voltage V0*i*, a fifth voltage source 3210 for providing reference voltage VCn, and a sixth voltage source 3212 for providing reference voltage VCi. Each of voltage sources 3202, 3204, 3206, 3208, 3210, and 3212 are shown three times in FIG. 32 for clarity, but those skilled in the art will understand that each is a single voltage source which may be an on chip voltage generator or simply a terminal for receiving the respective voltages from an off chip source.

Voltage controller 3200 further includes a first multiplexer 3214, a second multiplexer 3216, and a third multiplexer 3218. First multiplexer 3214 has a first input terminal coupled to first voltage source 3202, a second input terminal coupled to second voltage source 3204, a third input terminal coupled to third voltage source 3206, a fourth input terminal coupled fourth voltage source 3208, a fifth input terminal coupled to fifth voltage source 3210, a sixth input terminal coupled to sixth voltage source 3212, an output terminal coupled to common voltage supply terminal 626, and a 3-bit control terminal set coupled to VC control lines 3220 of voltage control bus 616. Second multiplexer 3216 has a first input terminal coupled to first voltage source 3202, a second input terminal coupled to second voltage source 3204, a third input terminal coupled to third voltage source 3206, a fourth input terminal coupled fourth voltage source 3208, a fifth input terminal coupled to fifth voltage source 3210, a sixth input terminal coupled to sixth voltage source 3212, an output terminal coupled to first voltage supply terminal 626, and a 3-bit control terminal set coupled to V1 control lines 3222 of voltage control bus 616. Third multiplexer 3218 has a first input terminal coupled to first voltage source 3202, a second input terminal coupled to second voltage source 3204, a third input terminal coupled to third voltage source 3206, a fourth input terminal coupled fourth voltage source 3208, a fifth input terminal coupled to fifth voltage source 3210, a sixth input terminal coupled to sixth voltage source 3212, an output terminal coupled to second voltage supply terminal 624, and a 3-bit control terminal set coupled to V0 control lines 3224 of voltage control bus 616. Thus configured, voltage controller 3200 is capable, responsive to control signals from processing unit 606, via voltage control bus 616, of asserting an off state on display 600 based on any one of reference voltages V1*n*, V1*i*, V0*n*, V0*i*, VCn, or VCi.

Figure 33:
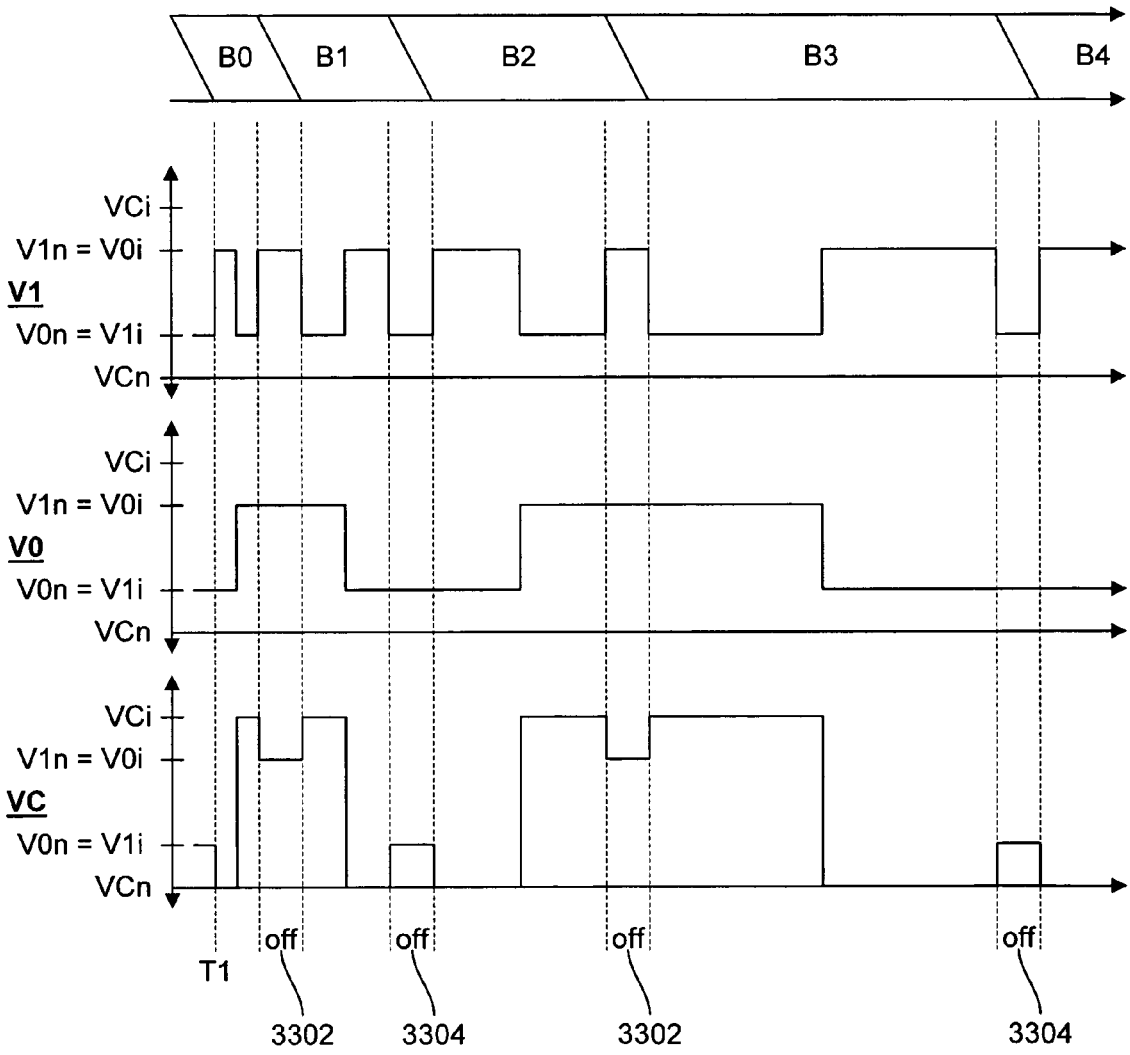
FIG. 33 is a timing diagram showing an alternate driving scheme in accordance with the present invention.

FIG. 33 is a timing diagram illustrating a method of driving display 600, using different off states to reduce the magnitude of the voltage swings on first voltage supply terminal 622, second voltage supply terminal 624, and common voltage supply terminal 626. The particular example shown here is in accordance with the voltage scheme shown in FIG. 12A, wherein V1*n* is equal to V0*i* and V1*i* is equal to V0*n*, but the concept of using multiple off state to reduce the magnitude of voltage swings is equally applicable to the other voltage schemes described herein.

Initially, voltage controller 3200 asserts a first off state on display 600 by asserting a same voltage V0*n* on each of first voltage supply terminal (V1) 622, second voltage supply terminal (V0) 624, and common voltage supply terminal (VC) 626. During this first off state, bit B0 is loaded into latches 702 of display 600. Then, at a time T1, voltage controller 3200 asserts a first predetermined voltage V1*n* on first voltage supply terminal 622 V1, a second predetermined voltage V0*n* on second voltage supply terminal 624 V0, and a third predetermined voltage VCn on common voltage supply terminal 626 VC. Then, after a predetermined time dependent on the significance of bit B0, voltage controller 3200 asserts a fourth predetermined voltage V1*i* on first voltage supply terminal 622 V1, a fifth predetermined voltage V0*i* on second voltage supply terminal 624 V0, and a sixth predetermined voltage VCi on common voltage supply terminal 626 VC. Next, voltage controller asserts a different off state 3302 on display 600 by asserting a different same voltage V1*n* on each of first voltage supply terminal 622, second voltage supply terminal 624, and common voltage supply terminal 626. The assertion of the different off state 3302 by voltage controller 3200 minimizes the voltage swing required on second voltage supply terminal 624 and common voltage supply terminal 626.

During off state 3302, bit B1 is written to latches 702 of display 600. Next, voltage controller asserts V1*i* on first voltage supply terminal 622, V0*i* on second voltage supply terminal 624, and VCi on common voltage supply terminal 626, and then asserts V1*n* on first voltage supply terminal 622, V0*n* on second voltage supply terminal 624, and VCn on common voltage supply terminal 626. Note that by asserting the debias state values prior to the normal state values following off state 3302, the necessary voltage swings on the voltage supply terminals 622, 624, and 626 are again minimized.

Following the debias and normal phase modulations for bit B1, voltage controller 3200 asserts an off state 3304 identical to the first off state, asserting voltage V0*n* on each of first voltage supply terminal (V1) 622, second voltage supply terminal (V0) 624, and common voltage supply terminal (VC) 626. Bit B2 is written to the storage elements 702 of display 600 during this off state 3304. Then, voltage controller 3200 asserts the normal modulation voltages, followed by the debias voltages to the respective voltage supply terminals 622, 624, and 626. In view of the foregoing explanation those skilled in the art will recognize the following reduced voltage swing modulation/debias pattern: first off state; normal modulation; inverted modulation; second off state; inverted modulation; normal modulation; first off state; normal modulation; inverted modulation; second off state; and so on.

Figure 34:
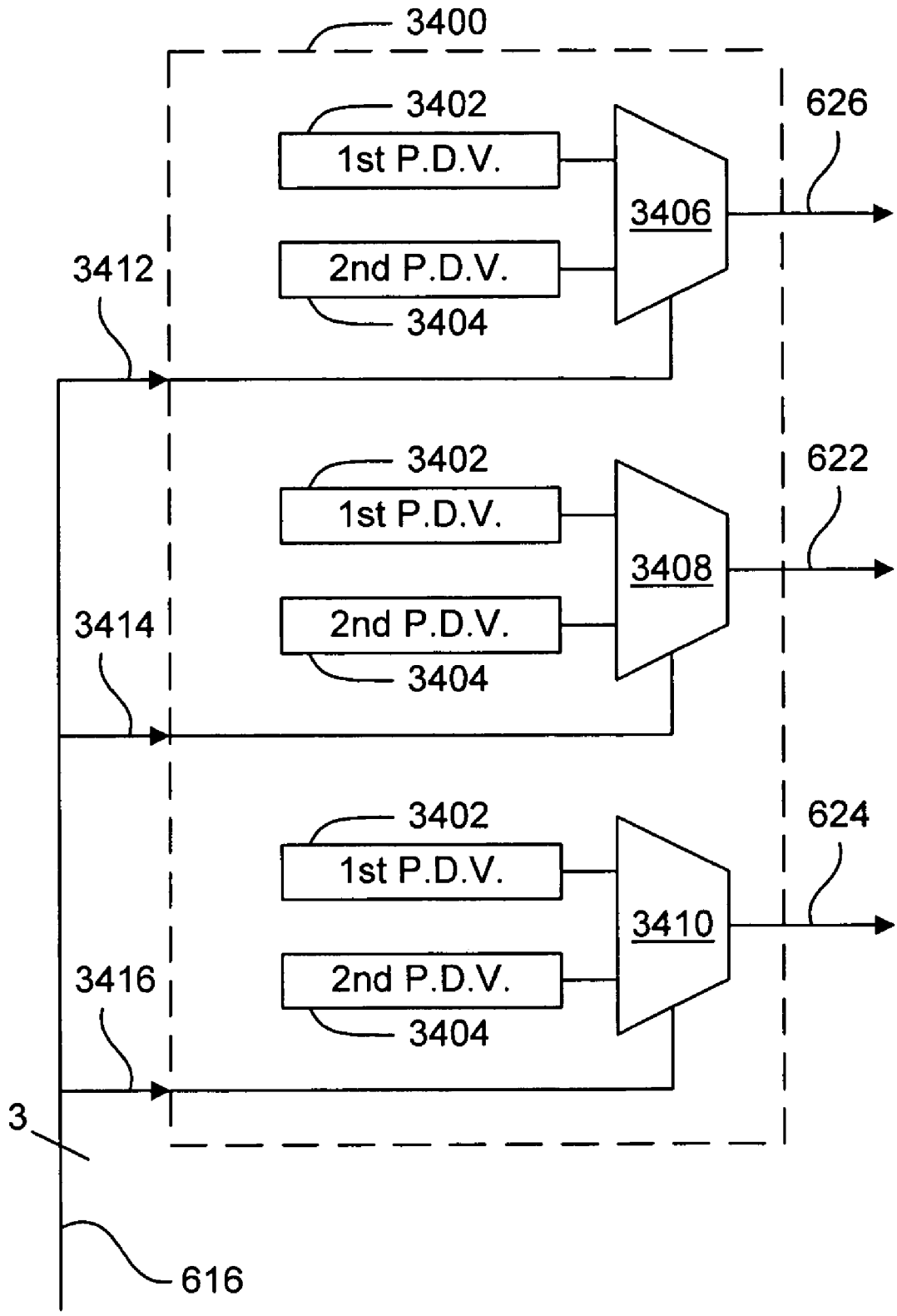
FIG. 34 is a block diagram of an alternate voltage controller capable of implementing a particular driving scheme in accordance with the present invention.

FIG. 34 is a block diagram of an alternate voltage controller 3400 for modulating display 600 with a minimal number of voltages (i.e., 2), relying primarily on time modulation. Voltage controller 3400 includes a first predetermined voltage source 3402, a second predetermined voltage source 3404, a first multiplexer 3406, a second multiplexer 3408, and a third multiplexer 3410. First predetermined voltage source 3402 and second predetermined voltage source 3404, although shown three times in FIG. 34 for the sake of clarity, should be understood to each be a single voltage source, in the nature of on chip voltage generators or simply terminals for receiving the respective voltages from an off chip source.

First multiplexer 3406 includes a first input terminal coupled to first predetermined voltage source 3402, a second input terminal coupled to second predetermined voltage source 3404, an output terminal coupled to common voltage supply terminal 626, and a control terminal coupled to a VC control line 3412 of voltage control bus 616. Second multiplexer 3408 includes a first input terminal coupled to first predetermined voltage source 3402, a second input terminal coupled to second predetermined voltage source 3404, an output terminal coupled to first voltage supply terminal 622, and a control terminal coupled to a V1 voltage control line 3414 of voltage control bus 616. Third multiplexer 3410 includes a first input terminal coupled to first predetermined voltage source 3402, a second input terminal coupled to second predetermined voltage source 3404, an output terminal coupled to second voltage supply terminal 624, and a control terminal coupled to a V0 voltage control line 3416 of voltage control bus 616. Responsive to particular control signals received from processing unit 606 via respective ones of control lines 3412, 3414, and 3416 of voltage control bus 616, multiplexers 3406, 3408, and 3410 selectively assert one the first or second predetermined voltages on voltage supply lines 626, 622, or 624, respectively.

Figure 35:
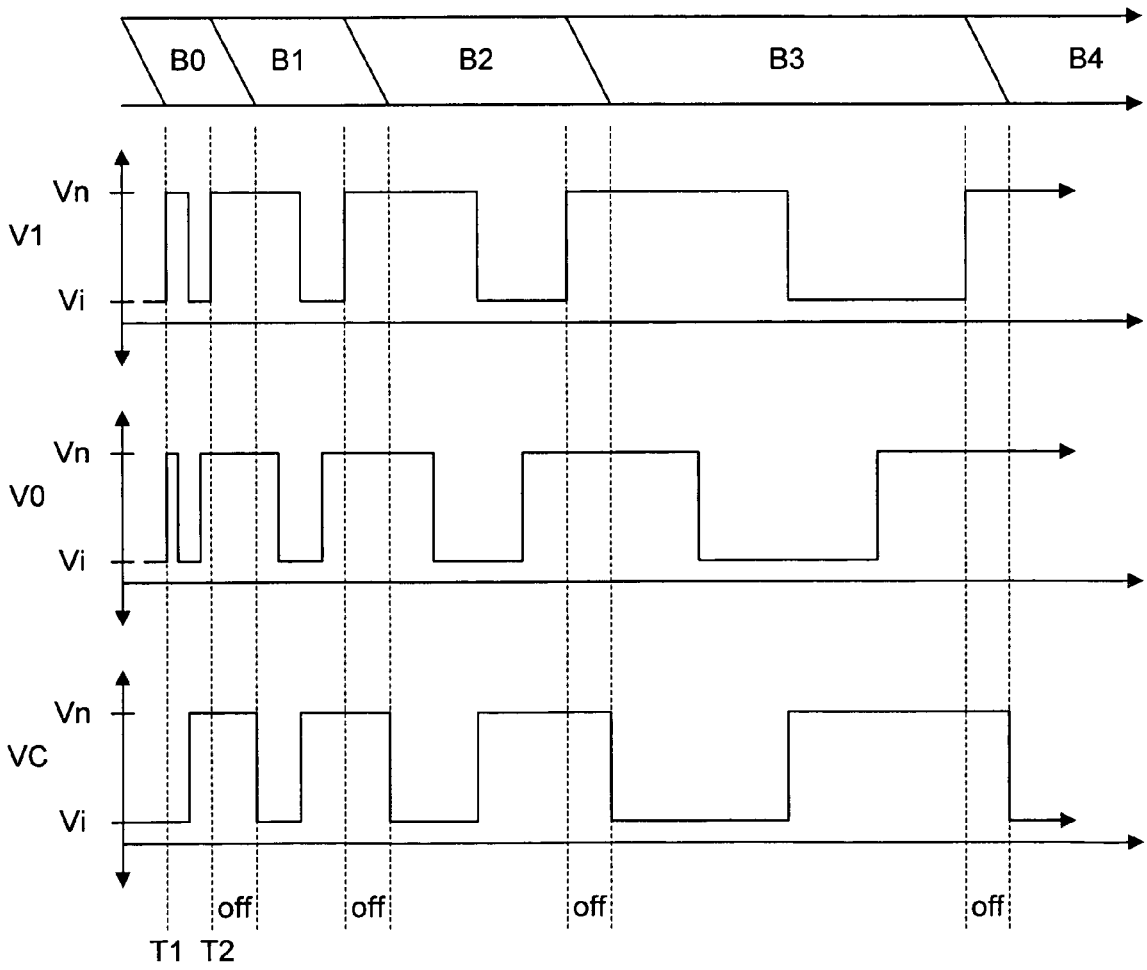
FIG. 35 is a timing diagram showing an alternate driving scheme in accordance with the present invention.

FIG. 35 is a timing diagram illustrating an alternate method of modulating and debiasing display 600 with voltage controller 3400 of FIG. 34. Initially, voltage controller 3400 asserts a first off state on display 600 by asserting the first predetermined voltage (Vi) on first voltage supply terminal (V1) 622, second voltage supply terminal (V0) 624, and common voltage supply terminal (VC) 626. During the first off state, bit B0 is loaded into storage elements 702 of display 600. Then, at a time T1 voltage controller 3400 asserts the second predetermined voltage (Vn) on V1 622 and V0 624. After a time period dependent on the significance of bit B0 and the threshold voltage (Vtt) of display 600, voltage controller 3400 returns V0 624 to Vi, turning V0 off. Next, after a period of time dependent on the significance of bit B0 and the saturation voltage (Vsat) of display 600, voltage controller 3400 asserts Vi on V1 622 and asserts Vn on VC 626. The effect of this transition is that V1 remains on, but in debias mode. Additionally, because V0 remains at Vi, the transition of VC to Vn turns V0 on in debias mode. After a period of time dependent on the significance of bit B0 and Vtt, voltage controller 3400 asserts Vn on V0, turning V0 off and completing V0's modulation and debias for bit B0. Then, after a period of time beginning when VC transitioned to Vn and dependent on the significance of bit B0 and Vsat, voltage controller 3400 asserts Vn on V1, completing the modulation and debias phases of V1 for bit B0. Voltage controller 3400 executes the modulation and debias phases of V1 and V0 in the same manner for subsequent bits, except that the respective time periods are extended due to their dependence on the significance of the subsequent bits, as shown in FIG. 35.

Figure 36:
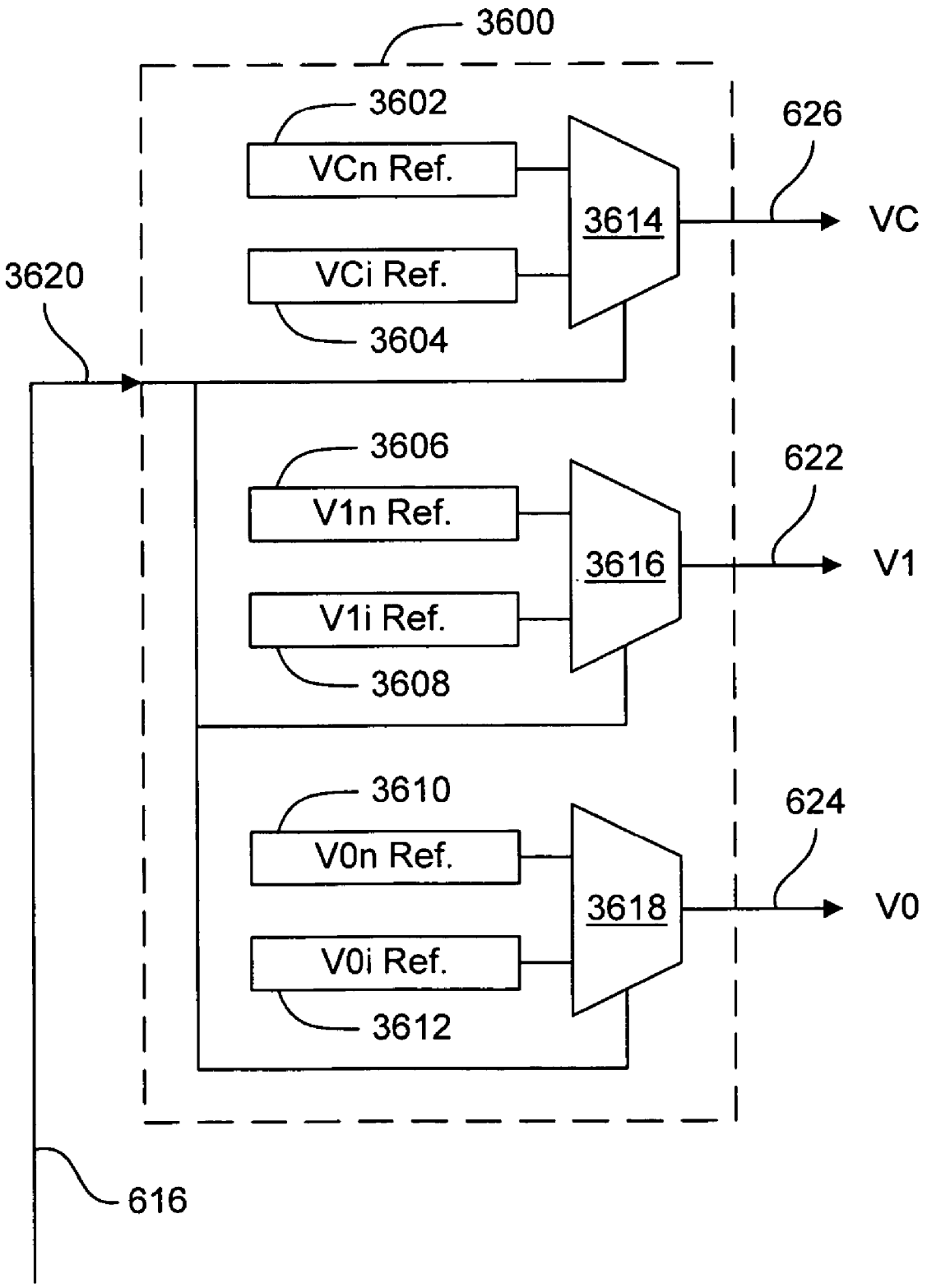
FIG. 36 is an alternate voltage controller capable of operation by a single control signal.

FIG. 36 is a block diagram of an alternate voltage controller 3600 capable of modulating and debiasing a display with a single control signal. Voltage controller 3600 includes a first voltage source 3602 for providing a VCn reference voltage, a second voltage source 3604 for providing a VCi reference voltage, a third voltage source 3606 for providing a V1*n* reference voltage, a fourth voltage source 3608 for providing a V1*i* reference voltage, a fifth voltage source 3610 for providing a V0*n* reference voltage, and a sixth voltage source 3612 for providing a V0*i* reference voltage. Voltage controller further includes a first multiplexer 3614, a second multiplexer 3616, and a third multiplexer 3618. First multiplexer 3614 includes a first input terminal coupled to voltage source 3602, a second input terminal coupled to second voltage source 3604, and output terminal coupled to common voltage supply terminal 626, and a control terminal coupled to a universal control line 3620 of voltage control bus 616. Second multiplexer 3616 includes a first input terminal coupled to voltage source 3606, a second input terminal coupled to second voltage source 3608, and output terminal coupled to first voltage supply terminal 622, and a control terminal coupled to a universal control line 3620 of voltage control bus 616. Third multiplexer 3618 includes a first input terminal coupled to voltage source 3610, a second input terminal coupled to second voltage source 3612, and output terminal coupled to second voltage supply terminal 624, and a control terminal coupled to a universal control line 3620 of voltage control bus 616.

Because the control terminals of multiplexes 3614, 3616, and 3618 are all coupled together, voltage controller functions as follows. Responsive to a first control signal on universal control line 3620, multiplexer 3614 asserts voltage VCn on common voltage supply terminal, multiplexer 3616 asserts voltage V1*n* on first voltage supply terminal 622, and multiplexer 3618 asserts voltage V0*n* on second voltage supply terminal 624. Responsive to a second control signal on universal control line 3620, multiplexer 3614 asserts voltage VCi on common voltage supply terminal, multiplexer 3616 asserts voltage V1*i* on first voltage supply terminal 622, and multiplexer 3618 asserts voltage V0*i* on second voltage supply terminal 624.

Voltage controller 3600 is particularly suited for use in a displays where simplicity and cost are prime consideration Because voltage controller 3600 is responsive to a single control signal, individual control of the various components is lost. For example, as shown, controller 3600 has the capability to provide debiasing for a display, but cannot provide off states. Optionally, a single signal controller could be configured to modulate and provide an off state, but not provide debiasing. Thus single signal controllers may be advantageously used, for example, in small displays where off states are not required to be able to write an entire display worth of data, or in displays not susceptible to deterioration from DC bias.

Several embodiments of the present invention implement off states (times when no voltage is being applied across the pixel cells), for example to provide adequate time to write data bits to the storage elements of the display. Other embodiments of the present invention described herein, employ predetermined voltages of varying amplitudes so as to be able to manipulate the time that a particular voltage is applied to a pixel cell. In many cases it is desirable to be able to select these predetermined voltages so as to closely reproduce the actual threshold and saturation voltages of the display.

For example, the actual values (V0) and (V1) used to implement the voltage scheme of FIG. 12 A can be calculated from the following RMS voltage equations. To calculate (V0), start with RMS voltage equation 1:

$$Vtt=\sqrt{(m\%)(VO-VC)^2}; \qquad \text{Eq. 1}$$

where Vtt is the threshold voltage of the display; m % is the modulation duty cycle (percent of time non-zero voltages are actually being applied to the pixel cells); VO is the actual voltage to be applied; and VC is the voltage applied to the common electrode. Setting VC equal to 0 volts simplifies the Eq. 1 to:

$$Vtt=\sqrt{(m\%)(VO)^2} \qquad \text{Eq. 2}$$

Squaring both sides of Eq. 2 gives:

$$Vtt^2=(m\ \%)(VO)^2 \qquad \text{Eq. 3}$$

Taking the square root of both sides of Eq. 3 gives:

$$Vtt=\sqrt{m\%}(VO) \qquad \text{Eq. 4}$$

Finally, solving for VO:

$$V0=\frac{Vtt}{\sqrt{m\ \%}} \qquad \text{Eq. 5}$$

A typical value can be obtained for illustrative purposes from the sample values in the chart of FIG. 12B. Assuming m %=0.8 and Vtt=1.0 volts, then V0=1.12 volts.

Similarly, the actual value for V1 can be calculated from Eq. 6 where Vsat is the saturation voltage of the liquid crystal display.

$$Vsat=\sqrt{(m\%)(V1-VC)^2} \qquad \text{Eq. 6}$$

Setting VC to 0 volts simplifies Eq. 6 to:

$$Vsat=\sqrt{(m\%)(V1)^2} \qquad \text{Eq. 7}$$

Squaring both sides of Eq. 7 gives:

$$Vsat^2=(m\ \%)(V1)^2 \qquad \text{Eq. 8}$$

Taking the square root of both sides of Eq. 8 gives:

$$Vsat=V1\sqrt{m\%} \qquad \text{Eq. 9}$$

Finally, solving Eq. 9 for V1 gives:

$$V1=\frac{Vsat}{\sqrt{m\ \%}} \qquad \text{Eq. 10}$$

Again, using the sample values from the chart of FIG. 12B (Vsat=3 volts), and assuming m %=0.8, then according to Eq. 10, V1=3.35 volts.

The description of particular embodiments of the present invention is now complete. Many of the described features may be substituted, altered or omitted without departing from the scope of the invention. For example, while the invention was described with reference to a reflective liquid crystal display, the use of the invention is not limited thereto, and may be advantageously employed in transmissive displays as well. Other such uses and advantages of the present invention will be apparent to those skilled in the art, particularly in light of this disclosure.

We claim:

1. A display comprising:

a first voltage source for providing a first predetermined voltage;

a second voltage source for providing a second predetermined voltage;

a pixel cell including a pixel electrode and a storage element for storing a data bit; and a plurality of switches, whereby said first voltage source and said second voltage source are selectively coupled to said pixel electrode, said plurality of switches including a first switch that is controlled by said data bit and a second switch that is controlled by a control signal that simultaneously controls other pixel cells of said display; and wherein responsive to a first value of said data bit and a first value of said control signal, said plurality of switches couple said first voltage source to said pixel electrode; and responsive to said first value of said data bit and a second value of said control signal, said plurality of switches couple said second voltage source to said pixel electrode.

2. A display according to claim 1, wherein said switches comprise multiplexers.

3. A display according to claim 1, wherein:

responsive to a second value of said data bit and said first value of said control signal, said plurality of switches couple said second voltage source to said pixel electrode; and responsive to said second value of said data bit and said second value of said control signal, said plurality of switches couple said first voltage source to said pixel electrode.

4. A display according to claim 1, wherein said second switch is disposed outside of said pixel cell.

5. A display according to claim 4, wherein said first switch is disposed within said pixel cell.

6. A display comprising:

a pixel electrode;

a common electrode;

a storage element for storing a data bit; and combinational logic operative to assert one of a plurality of predetermined voltages on said pixel electrode depending on a value of said data bit and a value of a control signal, said control signal determining a bias direction between said pixel electrode and said common electrode, said combination logic including a first switch including a first input terminal for receiving a first voltage, a second input terminal for receiving a second voltage, a control terminal for receiving said control signal, and an output terminal for providing one of said first and second voltages depending on a value of said control signal;

a second switch including a first input terminal for receiving said first voltage, a second input terminal for receiving said second voltage, a control terminal for receiving said control signal, and an output terminal for providing one of said first and second voltages depending on a value of said control signal; and a third switch including a first input terminal coupled to said output terminal of said first switch, a second input terminal coupled to said output terminal of said second switch, a control terminal coupled to said storage element, and an output terminal coupled to assert the output of said first switch or said second switch on said pixel electrode depending a value of said data bit.

7. A display according to claim 6, wherein a portion of said combinational logic serves other pixel electrodes of said display.

8. A display according to claim 7, wherein a second portion of said combinational logic exclusively serves said pixel electrode.

9. A display according to claim 6, wherein:

said first switch provides said first voltage responsive to a first value of said control signal; and said second switch provides said second voltage responsive to said first value of said control signal.

10. A display according to claim 9, wherein:

said first switch provides said second voltage responsive to a second value of said control signal; and said second switch provides said first voltage responsive to said second value of said control signal.

11. A display according to claim 6, wherein at least a portion of said combinational logic is included in a pixel cell associated with said pixel electrode.

12. A display according to claim 6, wherein at least a portion of said combinational logic is disposed outside of a pixel cell associated with said pixel electrode.

13. A display according to claim 9, wherein at least a portion of said combinational logic is a multiplexer controlled by said data bit.

* * * * *